US009857072B2

(12) United States Patent
Vartanian et al.

(10) Patent No.: US 9,857,072 B2
(45) Date of Patent: Jan. 2, 2018

(54) APPARATUSES, METHODS, AND SYSTEMS FOR ILLUMINATING PANELS USED AS CABINET DOORS AND DRAWER PANELS

(71) Applicant: American Heating Technologies, Inc., Los Angeles, CA (US)

(72) Inventors: Armond Vartanian, Los Angeles, CA (US); Raymond Vartanian, Los Angeles, CA (US)

(73) Assignee: American Heating Technologies Inc., Los Angeles, CA (US)

( * ) Notice: Subject to any disclaimer, the term of this patent is extended or adjusted under 35 U.S.C. 154(b) by 340 days.

(21) Appl. No.: 14/656,201

(22) Filed: Mar. 12, 2015

(65) Prior Publication Data

US 2015/0257596 A1 Sep. 17, 2015

Related U.S. Application Data

(60) Provisional application No. 61/951,981, filed on Mar. 12, 2014.

(51) Int. Cl.

| | |
|---|---|
| ***F21V 33/00*** | (2006.01) |
| *F21Y 103/10* | (2016.01) |
| *F21Y 115/10* | (2016.01) |

(52) U.S. Cl.

CPC ..... *F21V 33/008* (2013.01); *F21Y 2103/10* (2016.08); *F21Y 2115/10* (2016.08)

(58) Field of Classification Search

CPC . F21V 33/008; F21Y 2107/50; F21Y 2111/00
See application file for complete search history.

(56) References Cited

U.S. PATENT DOCUMENTS 2,623,313 A * 12/1952 Fuchs ..... G02B 6/0031 340/815.42
4,109,431 A * 8/1978 Mazzoni ..... E06B 3/677 428/34

(Continued)

FOREIGN PATENT DOCUMENTS

CA 2493654 A1 * 7/2006 ..... A47J 37/0786
CA 2835213 A1 * 11/2012 ..... F21S 8/04

(Continued)

OTHER PUBLICATIONS

"Ilumi: the world's smartest lights", retrieved from https://www.kickstarter.com/projects/ilumi/ilumi-the-worlds-smartest-lights; Apr. 2, 2014; 19 pages.

(Continued)

*Primary Examiner* — Sean Michalski
(74) *Attorney, Agent, or Firm* — Loza & Loza, LLP; Razmig Messerian

(57) ABSTRACT

One feature pertains to an illuminating panel. The illuminating panel may include a pane stack having a perimeter and a perimeter light source having a plurality of light sources positioned outside of the pane stack and around the perimeter of the pane stack. The perimeter light source may be adapted to provide light to the pane stack through side surfaces of the pane stack. The illuminating panel also includes a housing that houses the pane stack and the perimeter light source. A control unit, which may be remote controlled, may also communicatively couple to the perimeter light source and provide power and communication signals to the perimeter light source that changes at least one of a color, brightness, blinking pattern, and/or special effects of the perimeter light source.

18 Claims, 17 Drawing Sheets

(56) References Cited

U.S. PATENT DOCUMENTS 4,409,305 A * 10/1983 Goetschi ..... B41B 17/02 396/549
4,435,743 A * 3/1984 Plumly ..... G02B 6/0083 362/184
4,812,954 A * 3/1989 Marton ..... A47B 97/00 362/134
5,017,252 A * 5/1991 Aldrich ..... E06B 3/6775 156/104
5,027,258 A * 6/1991 Schoniger ..... G02B 6/0023 362/629
5,257,169 A * 10/1993 Walendziak ..... A45C 15/06 126/213
5,271,973 A * 12/1993 Huether ..... B44F 1/06 428/13
5,301,090 A * 4/1994 Hed ..... F21V 9/10 362/101
5,365,411 A * 11/1994 Rycroft ..... G09F 13/14 362/20
5,433,024 A * 7/1995 Lerner ..... G02B 6/007 362/613
5,628,242 A * 5/1997 Higley ..... A47J 37/0713 126/25 R
5,637,363 A * 6/1997 Leray ..... B32B 17/10045 156/106
5,664,873 A * 9/1997 Kanda ..... G02B 6/0051 349/62
5,743,616 A * 4/1998 Giuliano ..... G02B 6/0021 362/23.16
5,776,603 A * 7/1998 Zagdoun ..... C03C 17/23 359/580
5,781,878 A * 7/1998 Mizoguchi ..... G01N 27/4175 701/109
5,785,415 A * 7/1998 Matsumura ..... G09F 9/33 362/249.06
6,060,157 A * 5/2000 LaPerre ..... B44C 1/16 428/212
6,134,092 A * 10/2000 Pelka ..... G02B 6/0023 361/31
6,164,791 A * 12/2000 Gwo-Juh ..... G02B 6/0061 362/330
6,186,644 B1 * 2/2001 Mosseau ..... A47F 11/10 362/125
6,202,640 B1 * 3/2001 Naperola ..... A47J 37/0713 126/213
6,374,640 B1 * 4/2002 Fotheringham ..... C03B 32/00 65/111
6,431,165 B1 * 8/2002 Dow ..... A21B 3/16 126/25 R
6,481,131 B2 * 11/2002 Gianotti ..... G02B 6/0036 362/812
6,486,790 B1 * 11/2002 Perlo ..... G02B 6/003 340/321
6,880,963 B2 * 4/2005 Luig ..... G02B 6/0081 362/230
6,966,684 B2 * 11/2005 Sommers ..... G02B 6/0036 362/559
7,043,881 B2 * 5/2006 Krause, Sr. ..... E06B 3/66 362/145
7,121,675 B2 10/2006 Ter-Hovhannisian
7,255,671 B2 * 8/2007 Boone ..... A61G 11/006 600/21
7,758,104 B2 * 7/2010 Liebl ..... B60J 5/02 296/146.2
7,766,536 B2 * 8/2010 Peifer ..... F21S 8/00 362/155
7,954,975 B2 * 6/2011 Zhou ..... G02B 6/0043 362/147
8,033,686 B2 * 10/2011 Recker ..... H05B 33/0803 362/249.02
8,221,857 B2 * 7/2012 Jaeger ..... E06B 3/6612 156/109
8,303,158 B2 * 11/2012 Chien ..... G09F 9/33 362/249.02
8,362,681 B2 * 1/2013 Hussell ..... F21K 9/00 257/100
9,188,294 B1 * 11/2015 Wegner ..... F21S 8/026
9,476,552 B2 * 10/2016 Myers ..... F21S 8/026
2001/0049893 A1 * 12/2001 Maas ..... G02B 6/0036 40/544
2002/0047646 A1 * 4/2002 Lys ..... H05B 33/0803 315/312
2004/0004827 A1 * 1/2004 Guest ..... G02B 6/0091 362/612
2006/0075698 A1 4/2006 Alessandro
2006/0112483 A1 * 6/2006 Walker ..... A61H 33/60 4/541.1
2007/0153545 A1 * 7/2007 Lee ..... G02B 6/0073 362/610
2007/0171670 A1 * 7/2007 Zagar ..... G09G 3/3413 362/601
2007/0258263 A1 * 11/2007 Kim ..... F21S 8/033 362/602
2008/0192458 A1 * 8/2008 Li ..... A61B 1/0653 362/84
2008/0232093 A1 * 9/2008 Kim ..... E04B 9/32 362/147
2009/0128732 A1 * 5/2009 Hamada ..... G02B 6/0068 349/58
2012/0268966 A1 * 10/2012 McCollum ..... F21S 8/06 362/607
2015/0009454 A1 * 1/2015 Nagatani ..... G02B 6/005 349/65
2016/0259116 A1 * 9/2016 Van Bommel ..... F21S 48/115
2016/0356942 A1 * 12/2016 Cherekdjian ..... F21S 8/00
2017/0023232 A1 * 1/2017 Signorino ..... F21V 7/00
2017/0038058 A1 * 2/2017 Cano ..... F21V 33/004

FOREIGN PATENT DOCUMENTS

DE 19927068 A1 * 4/2001 ..... A47F 11/10
EP 1462599 A2 9/2004
EP 1645823 A2 4/2006
FR 2891608 A1 * 4/2007 ..... A47B 97/00
WO 20101023047 A1 3/2010

OTHER PUBLICATIONS

Stylmark "Backlit Displays & Transparency Frames", date unkown, 13 pages.
"MDC Interiors' Steel and Wood Glow Table Provides Dramatic Recessed LED Lighting", retrieved from http://inhabitat.com/mdc-interiors-steel-and-wood-glow-table-provides-dramatic-recessed-led-lighting/; Oct. 9, 2012; 4 pages.

* cited by examiner

APPARATUSES, METHODS, AND SYSTEMS FOR ILLUMINATING PANELS USED AS CABINET DOORS AND DRAWER PANELS

CLAIM OF PRIORITY

The present application for patent claims priority to U.S. provisional application No. 61/951,981 entitled "Lighting Apparatus for Framed Doors and Drawers used for Outdoor and Indoor Barbeque Units or Islands and Indoor Kitchen or Entertainment Centers" filed Mar. 12, 2014, the entire disclosure of which is hereby expressly incorporated by reference.

BACKGROUND

Field

Various features generally relate to doors and drawers, and in particular to apparatuses, methods, and systems for illuminating cabinet doors and front panels of drawers for outdoor and indoor kitchen products, such as barbecues and islands, and also for entertainment centers.

Background

Over the past several decades, the popularity of barbecue grills and outdoor cooking devices have increased tremendously. Such barbecue grills and outdoor cooking devices are now almost ubiquitous in the well-equipped home. In some cases, barbecue grills are portable in that they may be connected to a cart assembly and moved between various locations. Alternatively, barbecue grills may be incorporated into or connected to a fixed structure such as a built-in island. Whether portable or fixed, barbecue grills frequently have storage space behind cabinet doors and within drawers, which are typically located on the front side of the barbecue grill or island.

As the popularity of barbecue grills surges, so too does the demand for high end grills that do more than simply cook food and store items. There is a market for barbecue grills that provide entertainment and have improved aesthetics. The apparatuses, methods, and/or systems described herein are related to illuminating panels used for cabinet doors and drawers that can be incorporated into barbecue grills and islands, as well as other structures having cabinet doors and/or drawers such as, but not limited to, entertainment centers, kitchen cabinetry, etc. The aforementioned illuminating paneled doors and drawers provide entertainment to hosts and guests alike near the structures featuring them. The illuminating paneled cabinet doors and drawers also dramatically improve the aesthetics of the structure, such as a barbecue grill, having the illuminating panels including the indoor or outdoor space within which the structure resides.

SUMMARY

One feature provides an illuminating panel comprising a pane stack having a perimeter, a perimeter light source having a plurality of light sources positioned outside of the pane stack and around the perimeter of the pane stack, the perimeter light source adapted to provide light to the pane stack through side surfaces of the pane stack, and a housing that houses the pane stack and the perimeter light source. According to one aspect, the illuminating panel further comprises one or more hinges coupling the illuminating panel to a cabinet frame or a drawer frame including a cavity, the hinges adapted to swing the illuminating panel between a closed position and an open position, the illuminating panel sealing the cavity in the closed position and exposing the cavity in the open position. According to another aspect, the cabinet frame or door frame is part of a barbecue apparatus.

According to one aspect, the housing includes an outer frame and a rear cover plate, the rear cover plate securing to a back side of the outer frame to enclose the pane stack and the perimeter light source within the housing. According to another aspect, the outer frame includes a front surface having an open center portion that exposes a front surface of the pane stack. According to yet another aspect, the illuminating panel further comprises a pane stack brace that secures the pane stack to the housing.

According to one aspect, the pane stack brace includes a first member having a first surface and a second member having a second surface, the first and second surfaces being substantially orthogonal to each other, the first surface facing the side surfaces of the pane stack and securing the perimeter light source, and the second surface coupling to a back side perimeter of the pane stack. According to another aspect, the pane stack includes a first pane, a second pane, and a buffer layer positioned in between the first pane and the second pane, the first pane and the second pane each having transparent or translucent side surfaces that allow light generated at the perimeter light source to pass through. According to yet another aspect, the first pane includes a front surface and an opposing back surface, the front surface being substantially smooth and transparent and the back surface being at least one of etched and/or sandblasted, the back surface adapted to diffuse light.

According to one aspect, the second pane includes a front surface and an opposing back surface, and at least one of the second pane's front surface and/or the second pane's back surface is reflective, the first pane's back surface coupled to a first side of the buffer layer and the second pane's front surface coupled to a second side of the buffer layer. According to another aspect, the buffer layer includes at least one of a transparent or translucent interlayer laminate and/or a light diffusing sheet. According to yet another aspect, the illuminating panel further comprises a control unit communicatively coupled to the perimeter light source and adapted to provide power and communication signals to the perimeter light source.

According to one aspect, the communication signals provided by the control unit control at least one of a color, a brightness, and/or a blinking pattern of the plurality of light sources of the perimeter light source. According to another aspect, the control unit includes a wireless communication interface adapted to communicate with a remote control device, the remote control device having a graphical user interface (GUI) allowing a user to make selections that wirelessly control at least one or a color, brightness, blinking pattern, and/or special effects of the plurality of light sources.

Another feature provides an apparatus comprising a frame, a barbecue grill positioned on the frame, a heating source coupled to the barbecue grill and adapted to heat the barbecue grill, and at least one of a drawer and/or a cabinet coupled to the frame, the at least one drawer and/or cabinet including an illuminating panel, the illuminating panel including a pane stack having a perimeter, a perimeter light source having a plurality of light sources positioned outside of the pane stack and around the perimeter of the pane stack, the perimeter light source adapted to provide light to the pane stack through side surfaces of the pane stack, and a housing that houses the pane stack and the perimeter light source. According to one aspect, the housing includes an outer frame and a rear cover plate, the rear cover plate securing to a back side of the outer frame to enclose the pane stack and the perimeter light source within the housing, the outer frame including a front surface having an open center portion that exposes a front surface of the pane stack. According to another aspect, the apparatus further comprises a pane stack brace that secures the pane stack to the housing, the pane stack brace including a first member having a first surface and a second member having a second surface, the first and second surfaces being substantially orthogonal to each other, the first surface facing the side surfaces of the pane stack and securing the perimeter light source, and the second surface coupling to a back side perimeter of the pane stack.

According to one aspect, the pane stack includes a first pane, a second pane, and a buffer layer positioned in between the first pane and the second pane, the first pane and the second pane each having transparent or translucent side surfaces that allow light generated at the perimeter light source to pass through. According to another aspect, the apparatus further comprises a control unit communicatively coupled to the perimeter light source and adapted to provide power and communication signals to the perimeter light source, the communication signals provided by the control unit control at least one of a color, a brightness, and/or a blinking pattern of the plurality of light sources of the perimeter light source, and a remote control device adapted to wirelessly communicate with the control unit, the remote control device having a display that shows a graphical user interface (GUI) allowing a user to make selections that wirelessly control at least one or a color, brightness, blinking pattern, and/or special effects of the plurality of light sources. According to yet another aspect, the apparatus further comprises a temperature sensor adapted to determine a temperature of the barbecue grill, the temperature sensor communicatively coupled to the control unit, wherein the control unit receives the temperature of the barbecue grill from the temperature sensor and compares it to a predetermined threshold temperature value, and if the temperature of barbecue grill received equals or exceeds the predetermined threshold temperature value the control unit changes at least one of the color, the brightness, the blinking pattern, and/or the special effects of the plurality of light sources.

Another feature provides an apparatus comprising a frame, a barbecue grill positioned on the frame, a heating source coupled to the barbecue grill and adapted to heat the barbecue grill, and at least one of a drawer and/or a cabinet coupled to the frame, the at least one drawer and/or cabinet including an illuminating panel that is adapted to illuminate and be adjustable in at least one of color, blinking pattern, brightness, and/or change special effect.

DETAILED DESCRIPTION

In the following description, specific details are given to provide a thorough understanding of the various aspects of the disclosure. However, it will be understood by one of ordinary skill in the art that the aspects may be practiced without these specific details. For example, circuits and structures may be shown in block diagrams in order to avoid obscuring the aspects in unnecessary detail. In other instances, well-known circuits, structures and techniques may not be shown in detail in order not to obscure the aspects of the disclosure. The word "exemplary" is used herein to mean "serving as an example, instance, or illustration." Any implementation or aspect described herein as "exemplary" is not necessarily to be construed as preferred or advantageous over other aspects of the disclosure.

Overview

One feature pertains to an illuminating panel. The illuminating panel may include a pane stack having a perimeter and a perimeter light source having a plurality of light sources positioned outside of the pane stack and around the perimeter of the pane stack. The perimeter light source may be adapted to provide light to the pane stack through side surfaces of the pane stack. The illuminating panel also includes a housing that houses the pane stack and the perimeter light source. A control unit, which may be remote controlled, may also communicatively couple to the perimeter light source and provide power and communication signals to the perimeter light source that changes at least one of a color, brightness, blinking pattern, and/or special effects of the perimeter light source.

Exemplary Barbecue Apparatus

Figure 1:
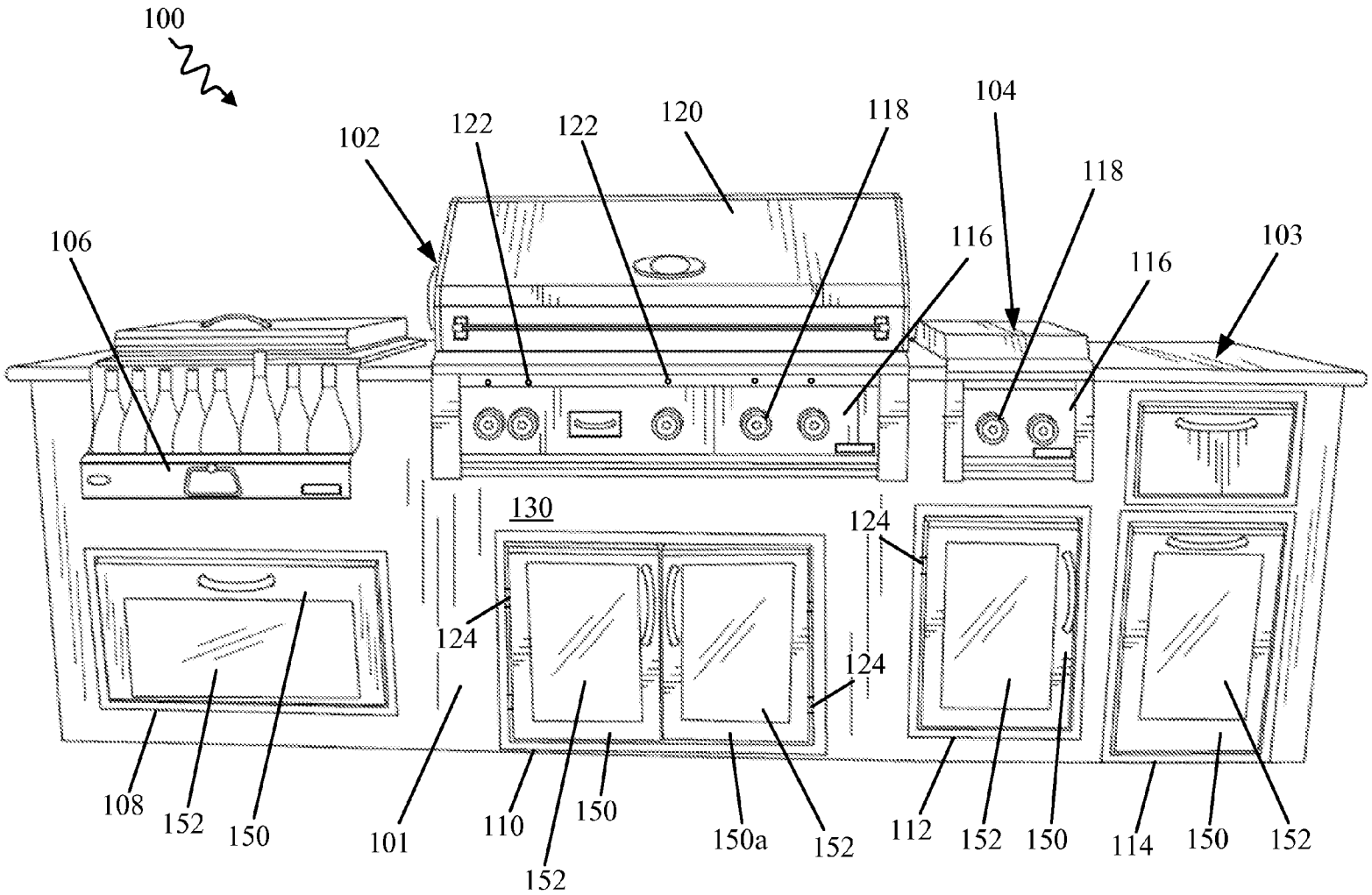
FIG. 1 illustrates a barbecue apparatus featuring illuminating doors and drawer panels.

FIG. 1 illustrates a barbecue apparatus 100 featuring illuminating doors and drawer panels according to one aspect. Among other things, the barbecue apparatus 100 includes a frame 101, a grill 102, and a countertop 103. The barbecue 100 may also include one or more side burners 104, bottle storage accessories 106, storage drawers 108, double-door storage cabinets 110, single door storage cabinets 112, and/or trash drawers 114.

The grill 102 and the side burner 104 may each include a control panel 116 that includes, among other buttons and indicators, one or more flame control knobs 118. The grill 102 may also include a grill hood 120 that covers the grilling surface underneath (not shown). The grill 102 and/or side burner 104 may include a plurality of small multi-color light sources 122 (e.g., hereinafter may be referred to "barbecue apparatus light sources") such as light emitting diodes (LEDs) that may change color. In one instance, the control panel 116, the control knobs 116, and/or other buttons/indicators on the control panel 116 may include the multi-color light sources 122.

The grill 102 and the side burner 104 substantially rest on top of the frame 101 and the countertop 103. Food and other items may also rest on the countertop 103. The frame 101 includes a front surface 130 where the drawers 108, 114, cabinets 110, 112, control panels 116, flame control knobs 118, and the bottle storage accessory 106 reside. Specifically, the drawers 108, 114 and cabinets 110, 112 may be fitted within ports (e.g. slots, cut-away portions, etc.) of the frame's 101 front surface 130.

Notably, the drawers 108, 114 and cabinets 110, 112 each include at least one illuminating panel 150, 150*a*. In the case of the cabinets 110, 112, the illuminating panels 150, 150*a* couple to hinges 124 thereby acting as cabinet doors. In the case of the drawers 108, 114, the illuminating panels 150 form the front face of the drawers 108, 114 and are pulled outward when the drawers 108, 114 are opened. As described in greater detail below, the illuminating panels 150, 150*a* include illuminating assemblies 152 that contain light sources that light up the illuminating panels 150, 150*a*.

The number of grills 102, side burners 104, bottle storage accessories 106, drawers 108, 114, cabinets 110, 112, and control knobs 116 shown in FIG. 1 is merely exemplary. In practice the barbecue apparatus 100 may feature any number or combination of grills 102, side burners 104, bottle storage accessories 106, drawers 108, 114, cabinets 110, 112, and control knobs 116.

Exemplary Illuminating Panels

Figure 2:
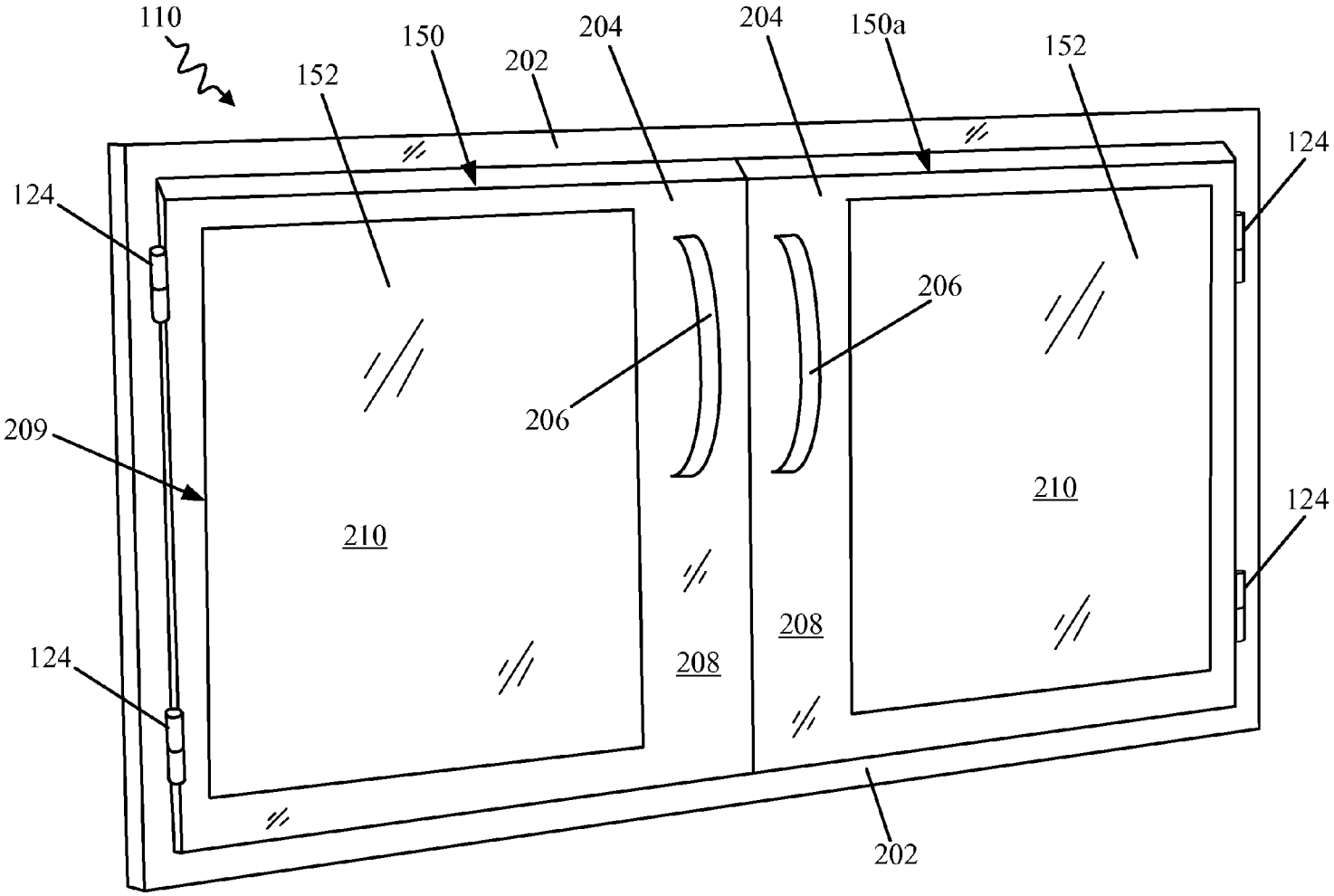
FIG. 2 illustrates a double-door storage cabinet with illuminating panels in a closed position.
Figure 3:
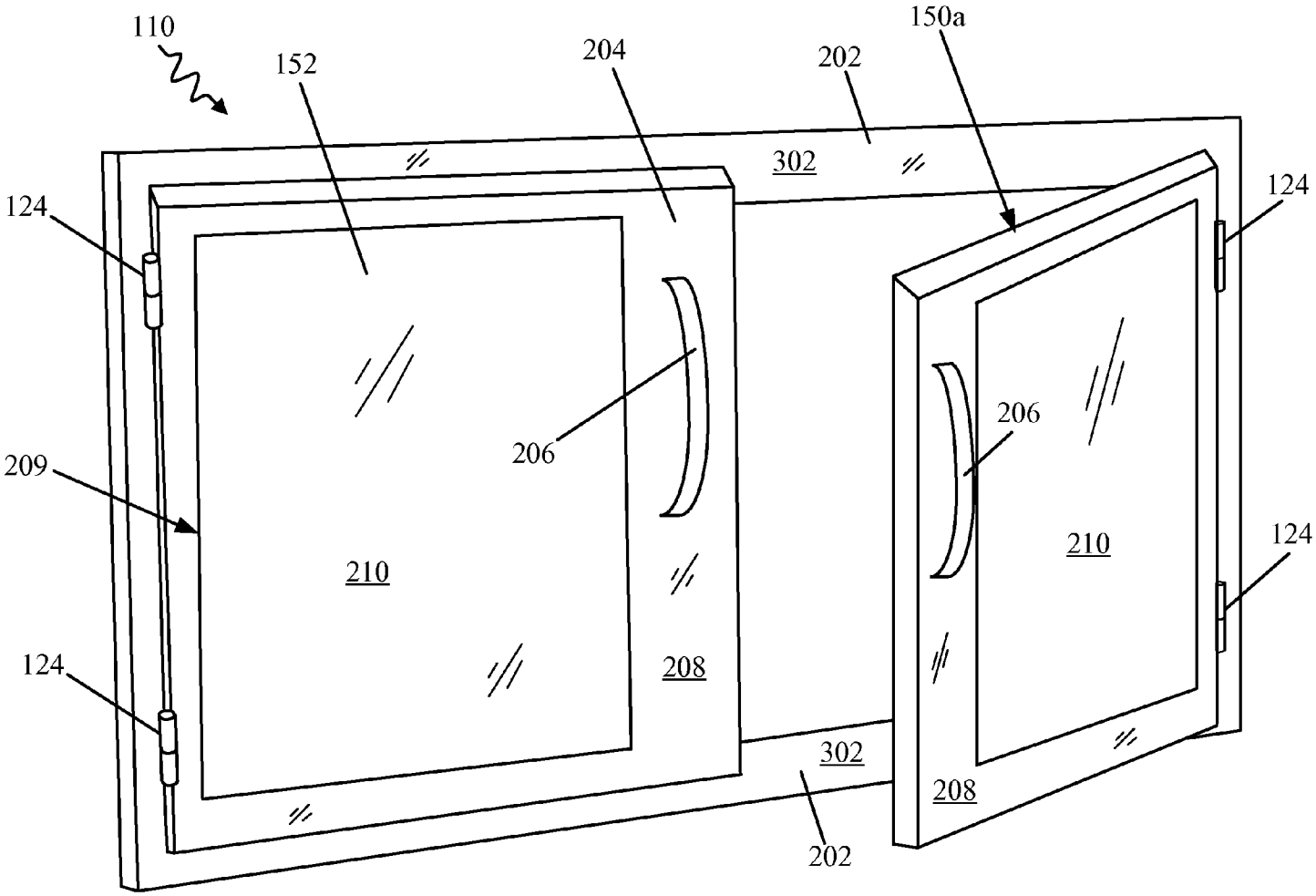
FIG. 3 illustrates a double-door storage cabinet with one illuminating panel partially open and another illuminating panel closed.
Figure 4:
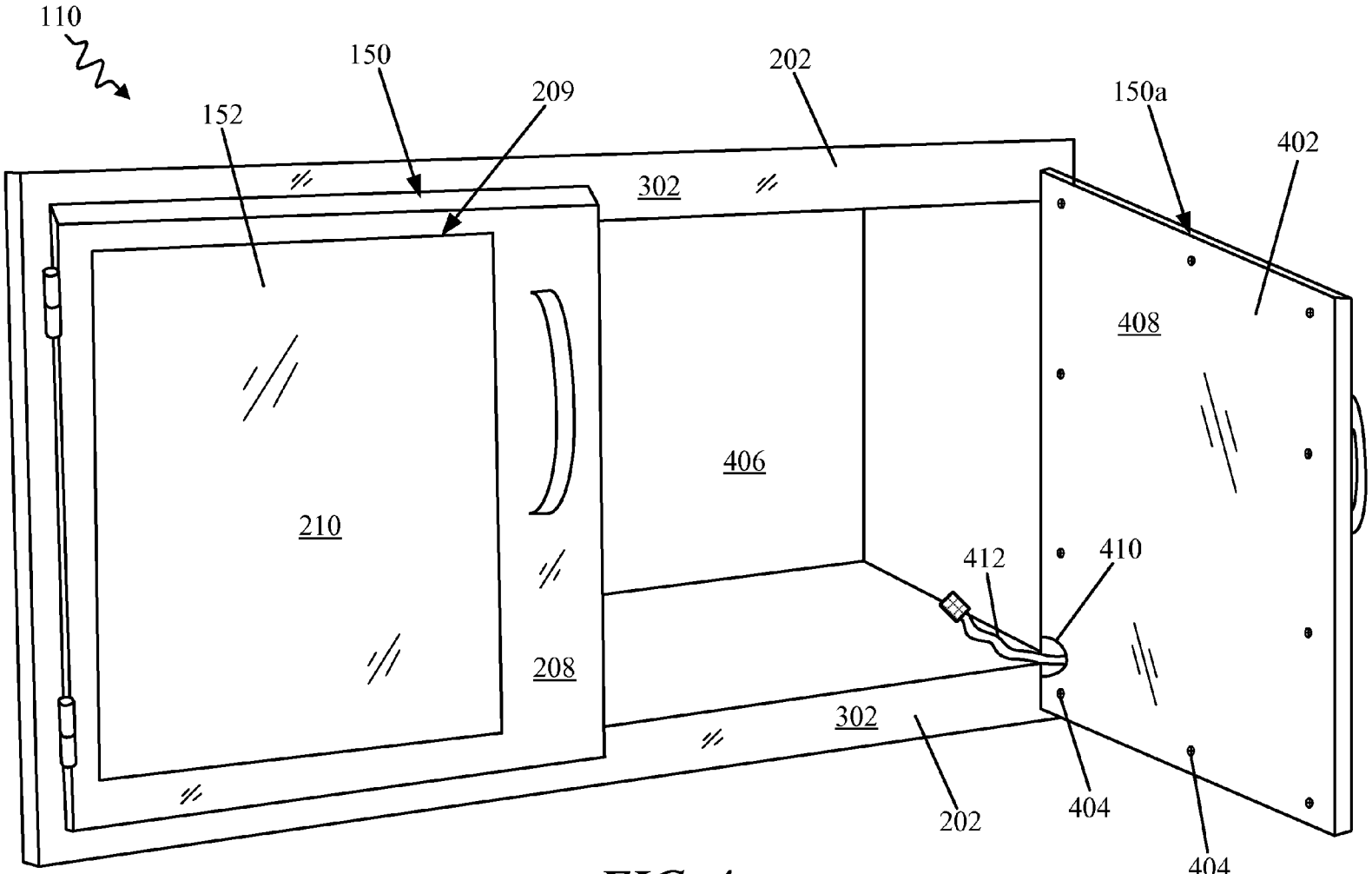
FIG. 4 illustrates a double-door storage cabinet with one illuminating panel fully open and another illuminating panel closed.

FIGS. 2, 3, and 4 illustrate, according to one aspect of the disclosure, the double-door storage cabinet 100 featuring illuminating panels 150, 150*a* in greater detail. In the example shown, the illuminating panels 150, 150*a* act as doors of the cabinet 110. FIG. 2 illustrates the double-door storage cabinet 110 with the illuminating panels 150, 150*a* in a closed position. FIG. 3 illustrates the double-door storage cabinet 110 with one illuminating panel 150*a* partially open and the other illuminating panel 150 closed. FIG. 4 illustrates the double-door storage cabinet 110 with one illuminating panel 150*a* fully open and the other illuminating panel 150 closed.

Referring to FIGS. 2-4, the storage cabinet 110 includes a cabinet frame 202, illuminating panels 150, 150*a*, and hinges 124. The hinges 124 couple the illuminating panels 150, 150*a* to the cabinet frame 202 and allow the panels 150, 150*a* to swing open and close. The cabinet frame 202 includes a front surface 302.

The illuminating panels 150, 150*a* may each include an outer frame 204, an illuminating assembly 152, and a handle 206. The outer frame 204 may include a rear cover plate 402 that secures to the back of the outer frame 204 with, for example, a plurality of screws 404. Together, the rear cover plate 402 and outer frame 204 form a housing within which the illuminating assembly 152 resides. Thus, the illuminating assembly is secured within the outer frame 204 and the rear cover plate 402. The rear cover plate 402 may include a cutaway slot 410 for allowing a communication and power cable 412 coupled to the illuminating assembly 152 to extend out from the rear cover plate 402.

The outer frame 204 covers the outer perimeter of the illuminating assembly 152, and the rear cover plate 402 covers the back of the illuminating assembly 152. However, a portion of the front surface 210 of the illuminating panels 150, 150*a* remains exposed and is not covered by the outer frame 204. The rear cover plate 402 and the outer frame 204 may be composed of a metal or metal alloy such as, but not limited to, steel, stainless steel, aluminum, etc. In some aspects, the outer frame 204 and rear cover plate 402 may be composed of wood or plastic.

The outer frame 204 also includes a front surface 208 to which a handle 206 may be attached. As shown in FIGS. 2-4, the outer frame's front surface 208 includes an open center portion 209 that exposes the illuminating panels' front surface 210. When the illuminating panels 150, 150*a* are secured to the cabinet frame 202 with hinges 124, pulling on the handles 206 opens the illuminating paneled doors so that the storage cavity 406 of the cabinet 110 may be accessed.

As will be described in greater detail below, the illuminating assembly 152 may include multiple panes of glass and/or thermoplastic along with a light source that lights up the illuminating assembly 152. In one aspect, the illuminating assembly 152 is able to: light up in a spectrum of colors (e.g., red, orange, yellow, green, blue, purple, etc.); blink ON and OFF; and change color and/or blink in rhythm to music. According to one aspect, the hinges 124 may provide power, ground, and/or communication signals to the illuminating assemblies 152.

Referring to FIG. 4, when the illuminating panels 150, 150*a* are in the closed position, a portion of a back side surface 408 of the rear cover plate 402 presses against the cabinet frame's front surface 302 thereby closing off the storage cavity 406 of the cabinet 110. A thin rubber mat (not shown) may be affixed (e.g., glued) around the perimeter of the rear cover plate's back side surface 408 to help create an airtight and watertight seal with the cabinet frame 202 when the illuminating panels 150, 150*a* are in the closed position.

Figure 5:
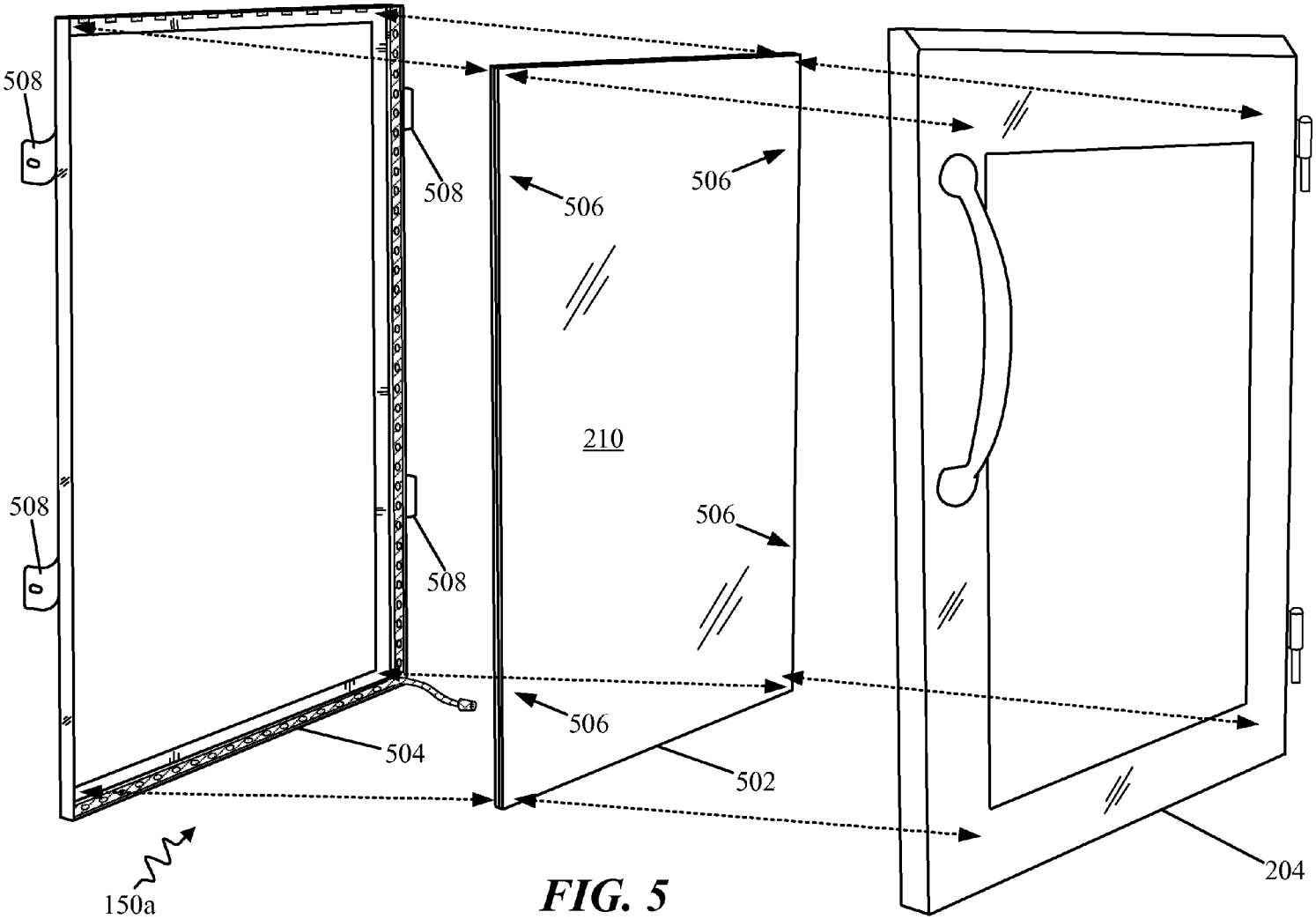
FIG. 5 illustrates an exploded, front perspective view of an illuminating panel.

FIG. 5 illustrates an exploded, front perspective view of the illuminating panel 150*a* (illuminating panel 150 is identical) according to one aspect of the disclosure. The illuminating panel 150*a* includes the outer frame 204, a pane stack 502, a pane stack brace 504, and the rear cover plate 402 (not shown in FIG. 5; see FIG. 4). As shown by the dashed lines, the pane stack 502 fits inside and secures to the pane stack brace 504. Specifically, the perimeter 506 of the pane stack 502 secures to the pane stack brace 504. Together, the pane stack 502 and the pane stack brace 504 may comprise the illuminating assembly 152 (see e.g., FIGS. 1-4). According to one example, the brace 504 may be composed of a metal or metal alloy including, but not limited to, aluminum, steel, stainless steel, etc.

Figure 6:
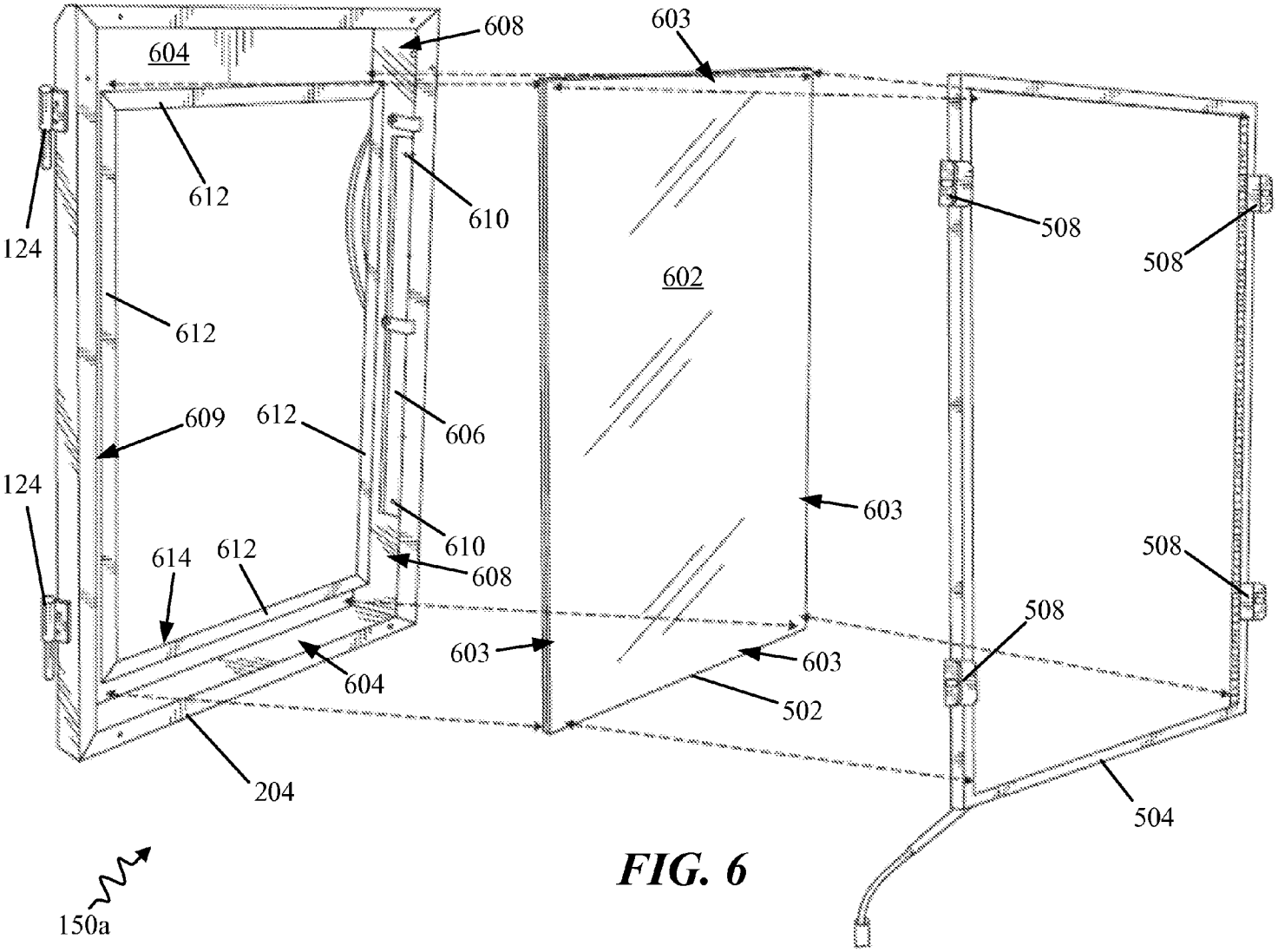
FIG. 6 illustrates an exploded, rear perspective view of an illuminating panel.

FIG. 6 illustrates an exploded, rear perspective view of the illuminating panel 150*a* according to one aspect of the disclosure. The illuminating panel 150*a* includes the outer frame 204, the pane stack 502, the pane stack brace 504, and the rear cover plate 402 (not shown in FIG. 6; see FIG. 4). The pane stack 502 includes a back surface 602 that is opposite the pane stack's 502 front surface 210 (see FIG. 5). Referring to FIG. 6, the pane stack 502 and the pane stack brace 504 secure to the back side 604 of the outer frame 204. The pane stack brace 504 also includes brackets 508 along its perimeter that allow the brace 504 to be secured to the bracket mounts 606 located along the side surfaces 608 of the outer frame's back side 604. The brackets 508 may secure to the bracket mounts 606 using screws (not shown) that fit into screw holes 610. Only one side surface 608 having a bracket mount 606 can be seen in FIG. 6. However, an additional bracket mount may be located on another side surface of the outer frame's back side 604 near the edge 609 that opposes the first side surface 608. This additional bracket mount also secures to the brace's brackets 508.

The back side 604 of the outer frame 204 may also include padding 612 along its inner perimeter 614. The padding 612 helps cushion the illuminating assembly 152 (e.g., pane stack 502 and brace 504) when it is mounted/secured to the bracket mounts 606 of the outer frame's back side 604. The padding 612 also helps create an airtight and/or watertight seal around the inner perimeter 614 after the illuminating assembly 152 is secured in place.

Figure 7:
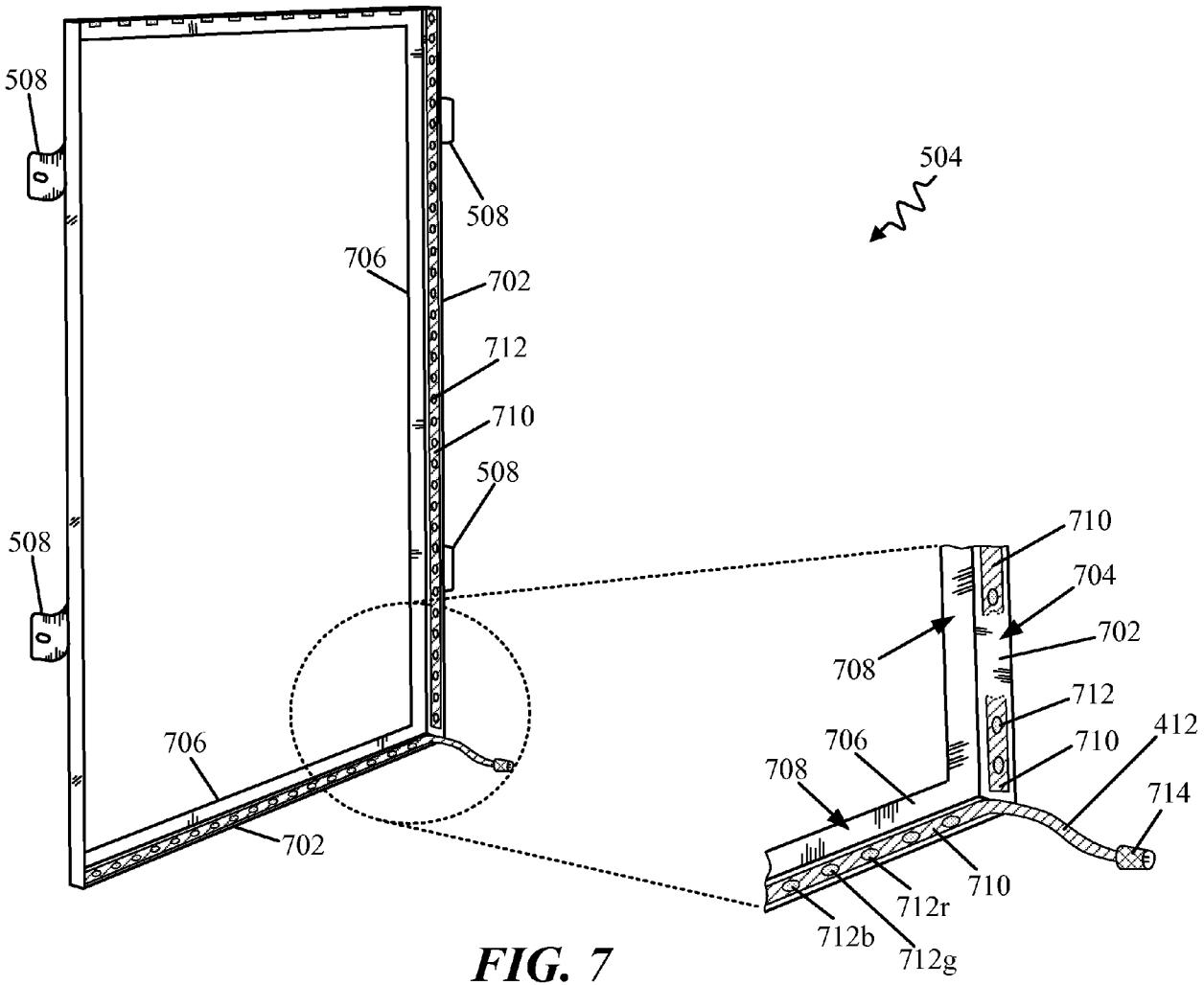
FIG. 7 illustrates a perimeter light source coupled to a pane stack brace.

FIG. 7 illustrates a perimeter light source 710 (e.g., may be referred to herein as a "light source strip") coupled to the pane stack brace 504 according to one aspect. Specifically, the brace 504 may include a first member 702 having a first surface 704 (a portion of a light source strip 710 has been removed to better show the first member 702 and the first surface 704) to which the light source strip 710 is secured. The light source strip 710 may extend about the entire inside perimeter of the brace 504 as shown. That is, the light source strip 710 may extend about the entire first member's first surface 704. According to one aspect, the light source strip 710 may be adhered to the first surface 704 with an adhesive. The brace's first surface 704 faces the sides of the pane stack 502.

The light source strip 710 may include a plurality of light sources (e.g., light emitting diodes (LEDs)) 712. The light sources 712 may be all the same color or different colors. In one aspect of the disclosure, the adjacent light sources 712 may produce different colors. For example, adjacent light sources 712 may alternate between producing red 712*r*, green 712*g*, and blue 712*b* light all the way around the perimeter of the brace 504. The different colored light sources 712*r*, 712*g*, 712*b* may be activated (i.e., turned ON) individually or in combination to produce a composite light signal having a wide spectrum of colors. As explained in greater detail below, the light sources 712 illuminate the pane stack 502 (see FIGS. 5 and 6) when it is secured to the brace 504.

The light source strip 710 also includes a communication and power cable 412 at one of its ends that includes a connector 714. The cable 412 supplies power and provides communication signals from a control unit (not shown in FIG. 7) to the light source strip 710 in order to power and control the light sources 712. The cable 412 includes a connector end 714 that couples to the control unit (not shown in FIG. 7). According to one aspect, the light source strip 710 may be wrapped in a transparent, insulating material in order to insulate the light sources 712 from electrical shorts that may be caused by moisture seeping into the illuminating panel 150, 150*a*. In one example, the transparent, insulating material may be composed of plastic, vinyl, and/or rubber.

Figure 8B:
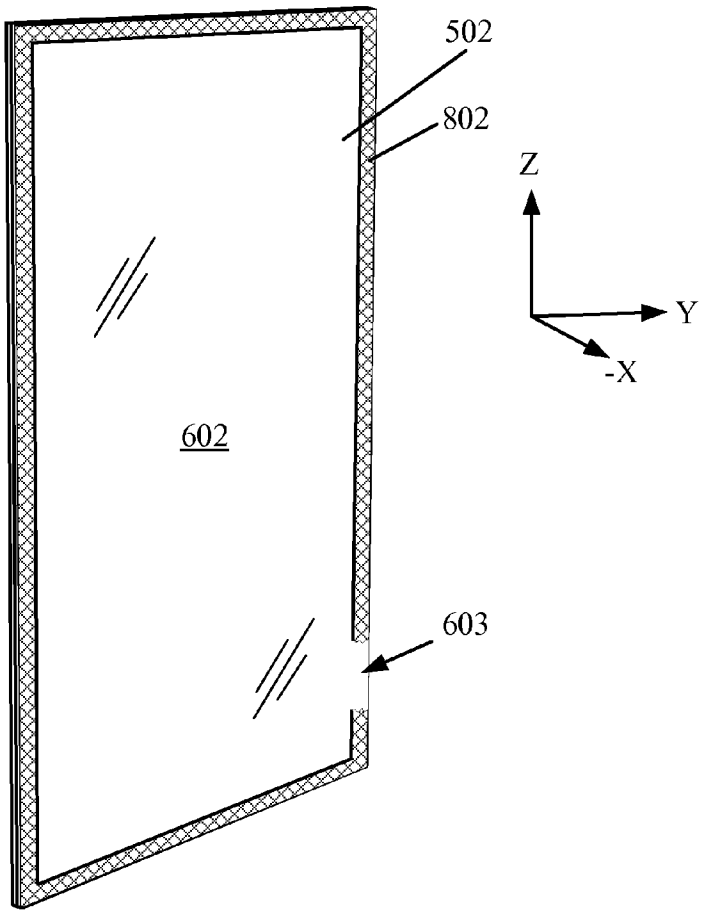
FIGS. 8A and 8B illustrate front and rear perspective views of a pane stack, respectively.

The brace 504 may further include a second portion 706 having a second surface 708 that is substantially orthogonal to the first member's first surface 704 an that faces the pane stack's back surface 602. Referring to FIGS. 6 and 7, the second member's second surface 708 couples/secures to the pane stack's back surface 602 at its back side perimeter 603 when the pane stack 502 is placed/housed within to the brace 504. Referring to FIGS. 6, 7, and 8B, a padding 802 that outlines the pane stack's back side perimeter 603 may rest between the second portion's second surface 708 and the pane stack's back side perimeter 603 to help create an airtight/watertight seal between the brace 504 and the pane stack 502. The padding may also help cushion and protect the pane stack 502 from damage since in one aspect the pane stack 502 may be composed of substantially glass and the brace 504 from metal.

With the pane stack 502 secured within the pane stack brace 504, the light source strip 710 is positioned around the entire perimeter of the pane stack 502 thereby providing light through the side surfaces of the pane stack 502. That is, light from the light source strip's light sources 712 permeate the pane stack 502 through the sides of the pane stack 502. Notably, the light source strip 710 and its light sources 712 are not embedded within the pane stack 502 itself. Rather they are positioned outside of the pane stack 502 along its perimeter. This allows for easy servicing of the light source strip 710.

Figure 8A:
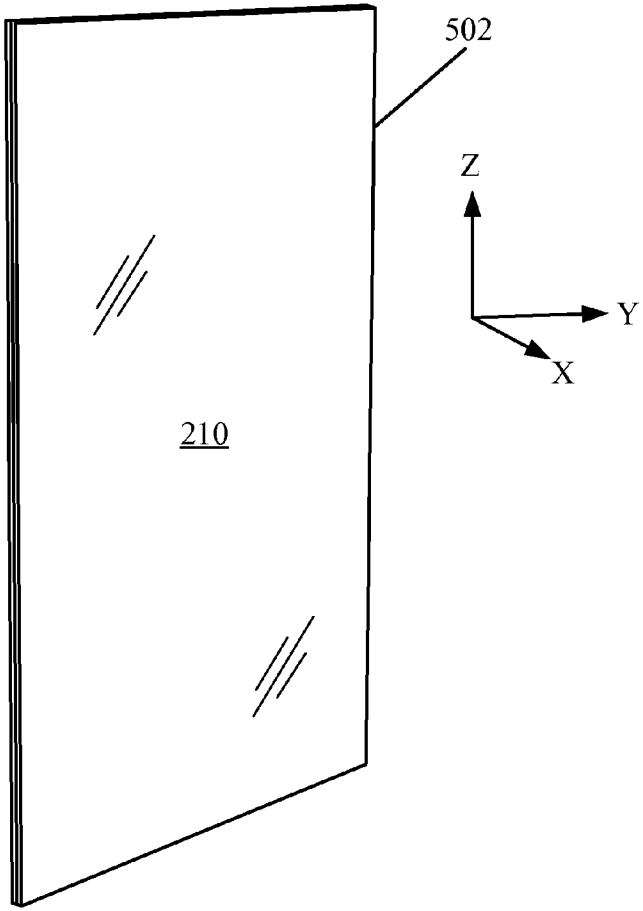
Figure 9:
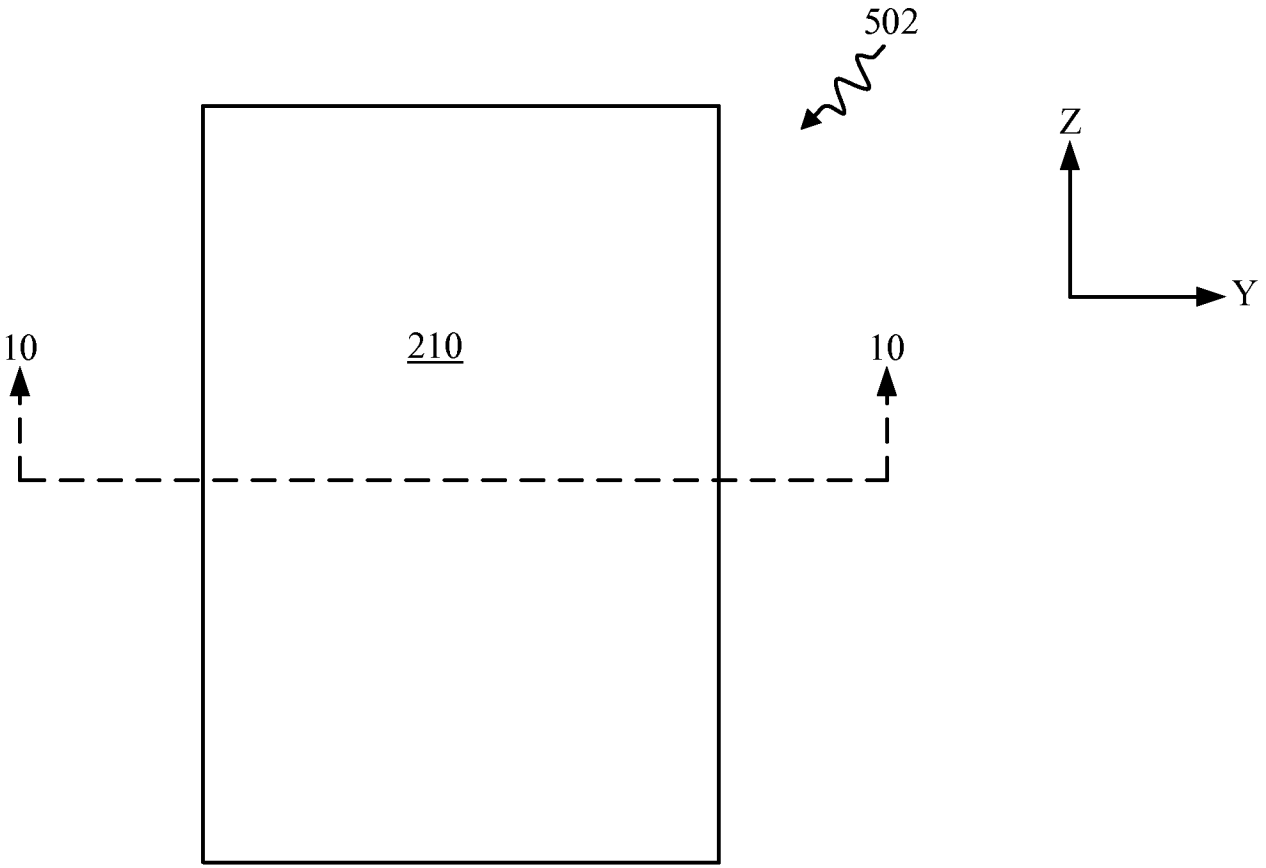
FIG. 9 illustrates a front view of a pane stack.
Figure 10:
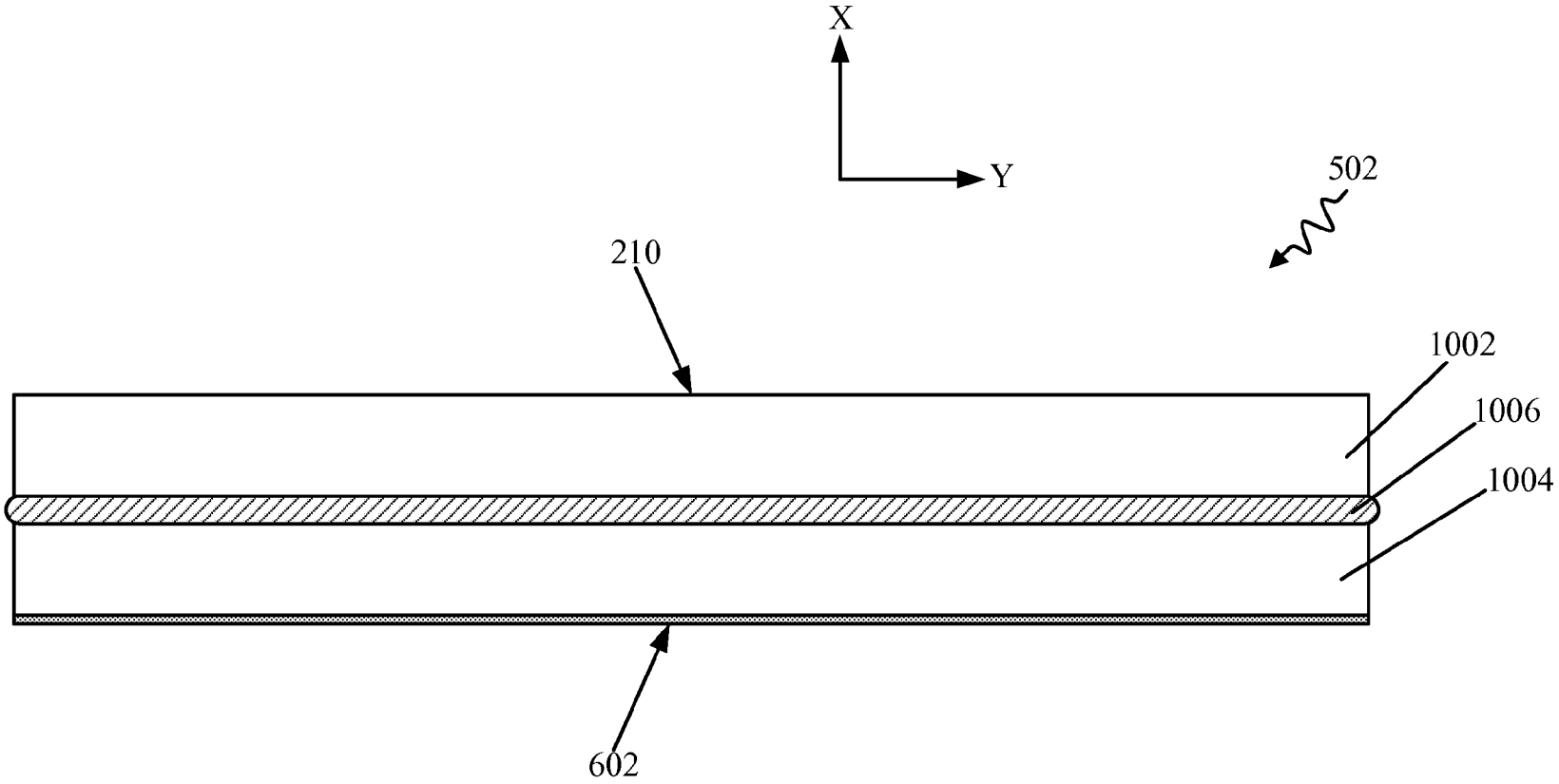
FIG. 10 illustrates a cross-sectional view of a pane stack.
Figure 11:
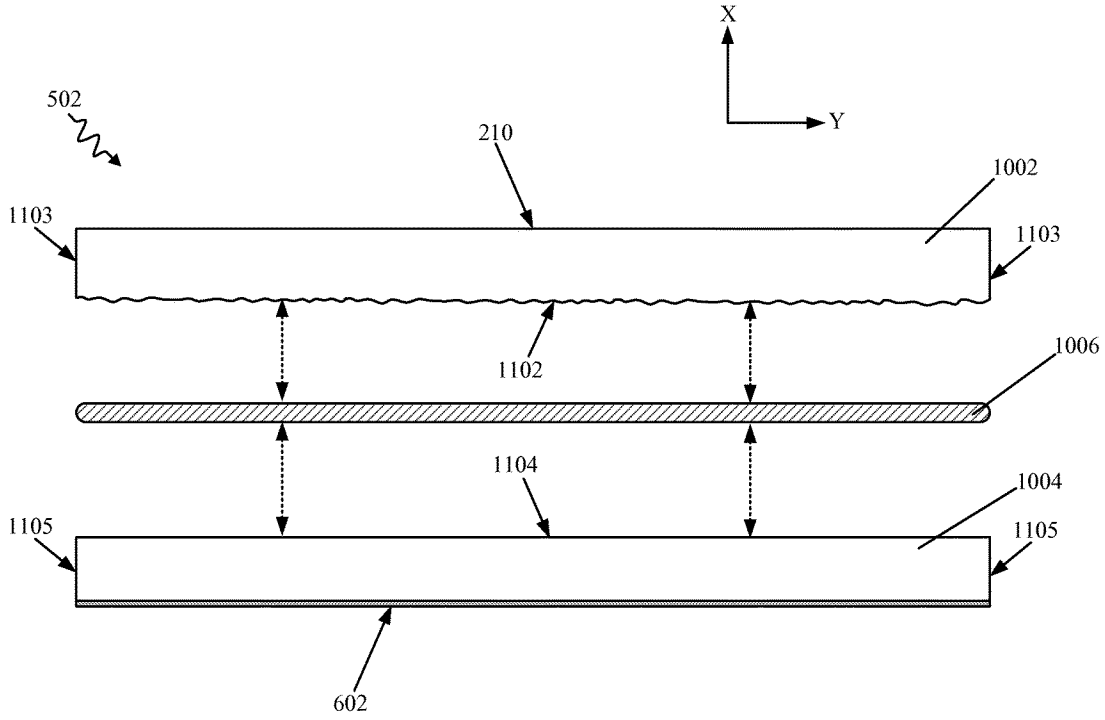
FIG. 11 is an exploded view of FIG. 10 which better shows the features and surfaces of the components that may comprise a pane stack.

FIGS. 8A, 8B, 9, 10, and 11 illustrate the pane stack 502 according to one aspect. Specifically, FIGS. 8A and 8B illustrate front and rear perspective views of the pane stack 502, respectively. FIG. 9 illustrates a front view of the pane stack 502. FIG. 10 illustrates a cross-sectional view of the pane stack 502 along the line 10-10 shown in FIG. 9. FIG. 11 is an exploded view of FIG. 10 which better shows the features and surfaces of the components that may comprise the pane stack 502.

Referring to FIG. 10, the pane stack 502 may include a first pane 1002, a second pane 1004, and a buffer layer 1006 in between the first and second panes 1002, 1004. The first and second panes 1002, 1004 may be composed substantially of glass, acrylic, and/or a hard thermoplastic such as, but not limited to, poly(methyl methacrylate) (PMMA). The buffer layer 1006 may be a transparent material (e.g., resin, substrate, sheet, etc.) that is deposited/formed/placed between the first and second panes 1002, 1004. According to one aspect, the buffer layer 1006 may be an interlayer laminate, such as polyvinyl butyral or ethylene-vinyl acetate, which may be suitable for outdoor applications (e.g., outdoor barbecues). According to another aspect, the buffer layer 1006 may be a light diffusing sheet, such as a tough, polyester base gel, which may be suitable for indoor applications. The light diffusing sheet may be fire, moisture, and fade resistant. The light diffusing sheet also diffuses (e.g., scatters) light. The buffer layer 1006 may adhere to the first and second panes 1002, 1004 thereby securing all three components 1002, 1004, 1006 together to form the pane stack 502. In one example, the first and second panes 1002, 1004 and the buffer layer 1006 may be substantially rectangular or square.

Referring to FIG. 11, in one aspect of the disclosure the first pane 1002 is a transparent or translucent pane of glass, acrylic, and/or thermoplastic that allows light to pass through either almost entirely or at least partially. The second pane 1004 may be a mirror that is also a pane of glass, acrylic, and/or thermoplastic.

The first pane 1002 includes a front surface (e.g., first surface) 210 on the front side of the first pane 1002 and a back surface (e.g., second surface) 1102 on the back side of the first pane 1002. The first pane's back surface 1102 is substantially parallel to and opposite its front surface 210. The first pane 1002 also includes side surfaces 1103 around its entire perimeter that may be substantially orthogonal to the front and back surfaces 210, 1102.

Referring to FIGS. 1, 2, and 10, the front surface 210 faces a person positioned in front of the illuminating panel 150. According to one aspect of the disclosure, the front surface 210 is substantially smooth and flat while the back surface 1102 is etched (e.g., acid etched, diamond etched, etc.) and/or sandblasted to create a frosted glass appearance. Thus, the back surface 1102 may be unsmooth and rugged to the touch like the front surface 210. Notably, such a configuration allows the front side of the first pane 1002, which may be touched and directly seen by people, to be smooth and flat to the touch and have sheen, while the etched/sandblasted back surface 1102 gives the first pane 1002 an overall frosted glass appearance and effect by scattering light passing through the first pane 1002 in the X direction. In other aspects, both the front and back surfaces 210, 1102 are flat and smooth (i.e., not etched) or the front surface 210 is etched/sandblasted instead of the back surface 1102.

Figure 12:
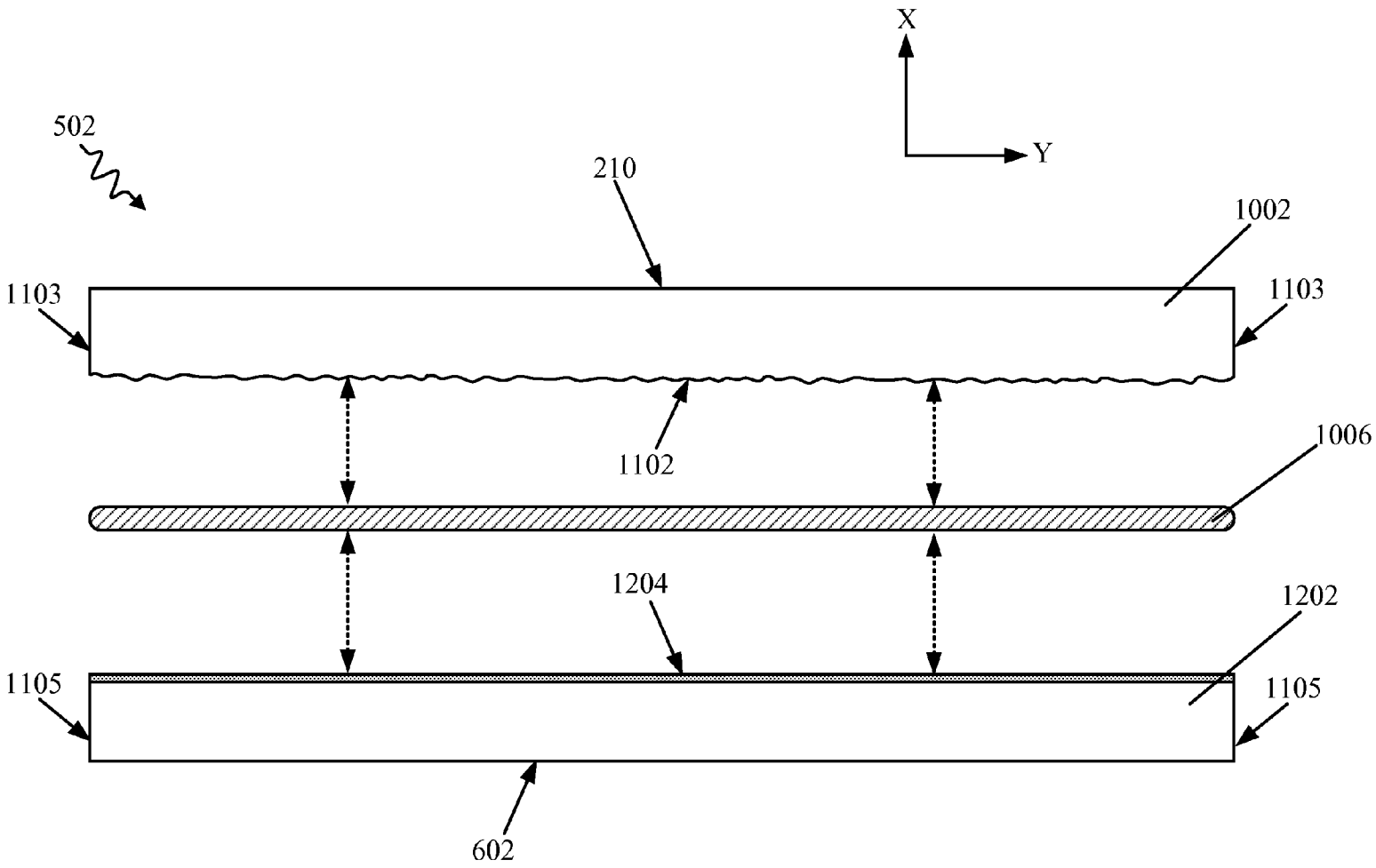
FIG. 12 illustrates a second pane that is a first surface mirror having a front surface that is a reflective surface.

The second pane 1004 includes a front surface (e.g., first surface) 1104 on the front side of the second pane 1004 and the back surface (e.g., second surface) 602 on the back side of the second pane 1004. In the illustrated example, the second pane 1004 is a second surface mirror where the back surface 602 is a reflective surface behind a transparent substrate such as glass or acrylic and the first surface 1104 is transparent. According to another example shown in FIG. 12, however, the second pane 1202 is a first surface mirror where the second pane's front surface 1204 is a reflective surface. The second pane 1202 may be, for example, a polished sheet of metal (e.g., polished stainless steel, aluminum, etc.) or a metallic foil having sheen (e.g., aluminum foil).

Referring to FIG. 10, according to one aspect, the second pane 1004 may instead be a flat panel display such as an LCD or LED display device.

Figure 13:
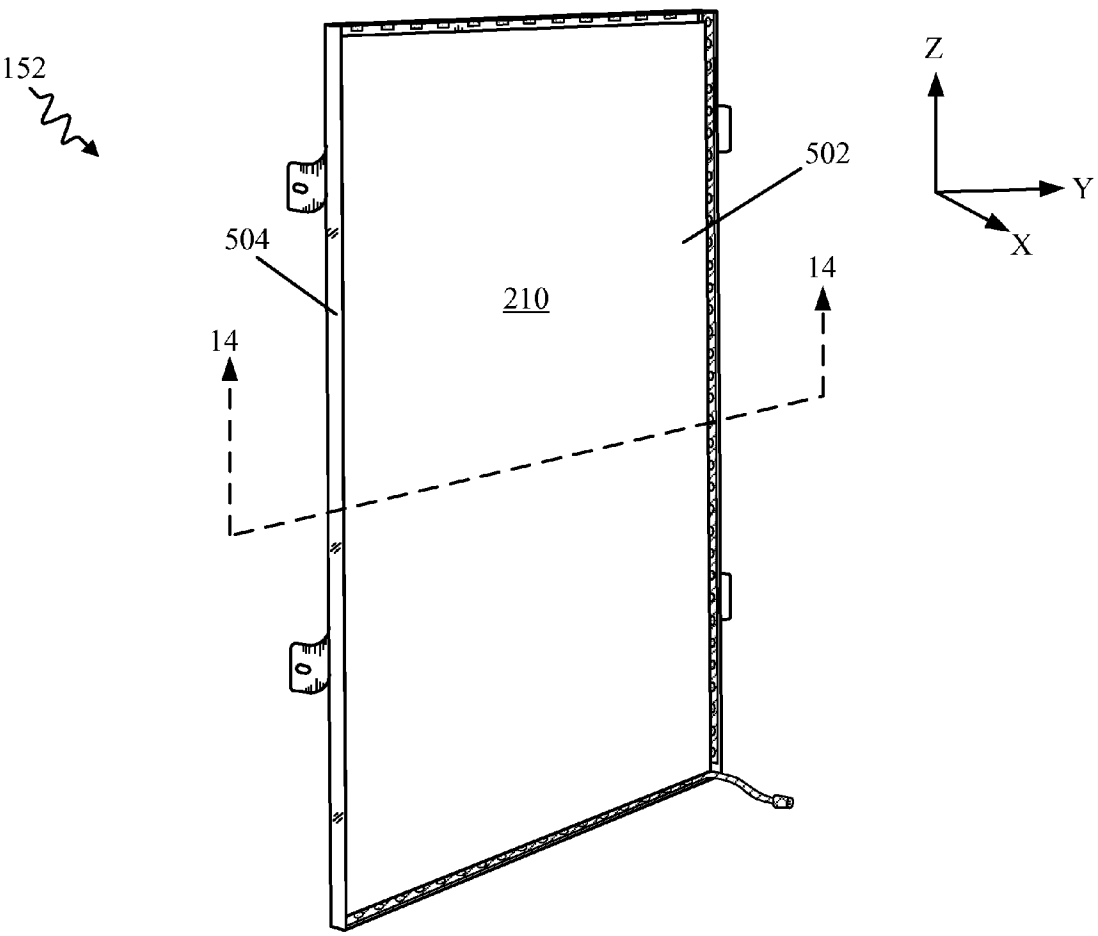
FIG. 13 illustrates a front perspective view of an illuminating assembly.
Figure 14:
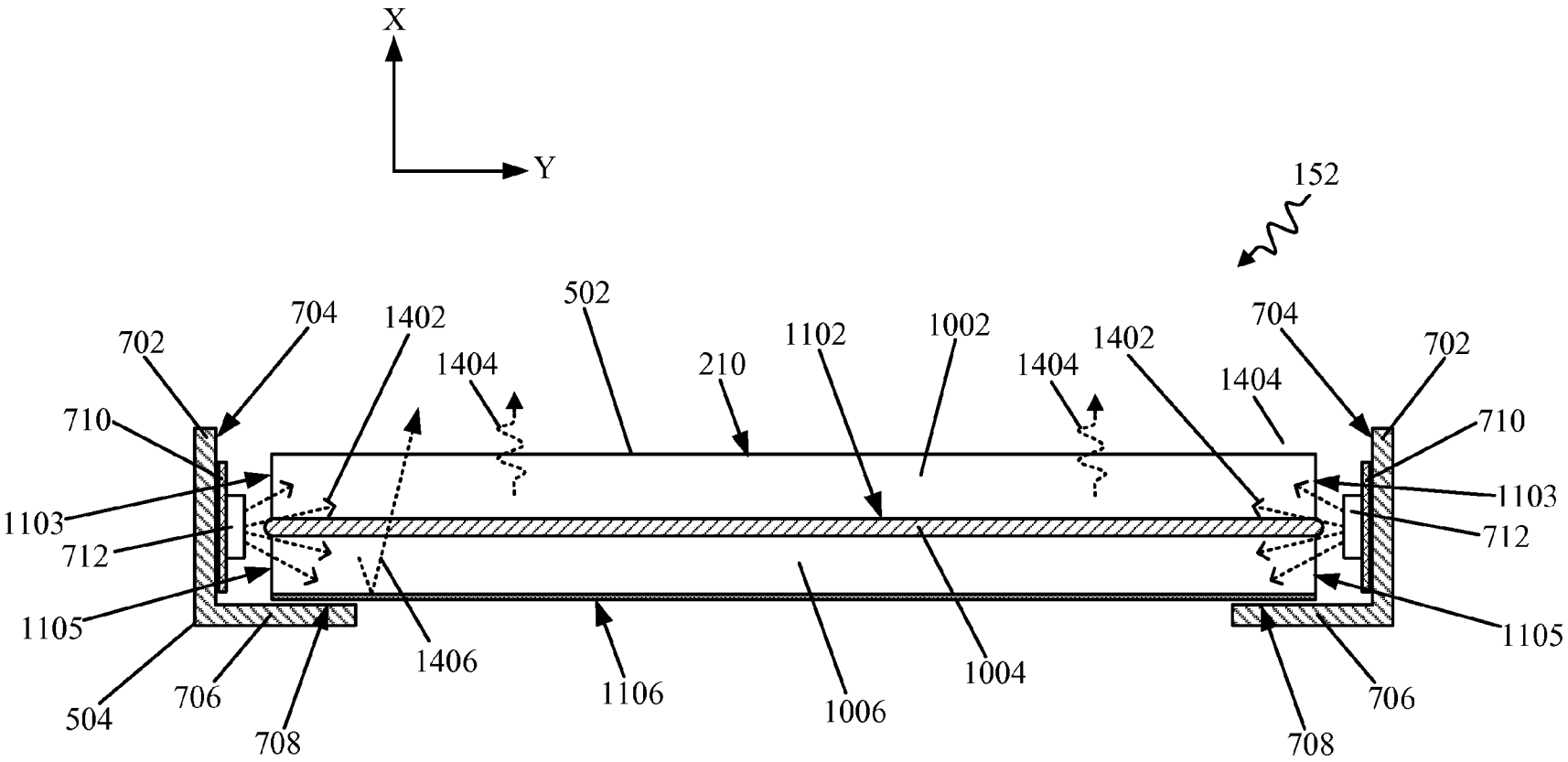
FIG. 14 illustrates a cross-sectional view of the an illuminating assembly.

FIGS. 13 and 14 illustrate the illuminating assembly 152 according to one aspect. Specifically, FIGS. 13 and 14 illustrate a front perspective view and a cross-sectional view along the line 14-14 of the illuminating assembly 152, respectively.

Referring to FIGS. 13 and 14, the pane stack 502 secures to and resides within the pane stack brace 504. When the illuminating assembly 152 is powered ON (i.e. power is supplied to the light source strip 710), the light sources 712 light up and light waves 1402 propagate into the pane stack 502 from the transparent or translucent side surfaces 1103, 1105 of the first and second panes 1002, 1004. Light waves 1402 may also propagate into the transparent buffer layer 1006 as well. In so doing, the light sources 712 illuminate the pane stack 502 and light 1404 propagates out of the front surface 210 of the pane stack 502 to observers positioned on the front side of the illuminating assembly 152.

To maximize the amount of light 1404 emanating out from the front of the pane stack 502, the reflective back surface 1106 (or the reflective front surface 1204) of the second pane 1004 reflects light 1406 back out the front surface 210 of the pane stack 502. In the case where the back surface 1102 of the first pane 1002 is frosted (i.e., etched or sandblasted), light 1402, 1404 within the pane stack 502 is scattered so as to give an observer viewing the front surface 210 of the pane stack 502 the impression that the pane stack 502 or part thereof is frosted glass. As described above, the light sources 712 may provide various wavelengths of light including red, blue, and green colors. In this fashion the illuminating assembly may generate a wide range of colors of the visible spectrum.

In one aspect of the disclosure, one or more illuminating panels 150, 150*a* described above may be coupled to a cabinet frame to act as a door to the cabinet. In another aspect, the one or more illuminating panels 150, 150*a* described above may be coupled to a drawer and act as the front facing panel of the drawer (e.g., the drawer 108 in FIG. 1 illustrating a front facing panel that is an illuminating panel).

Exemplary Control Unit, Remote Control Device, and Graphical User Interface

Figure 15:
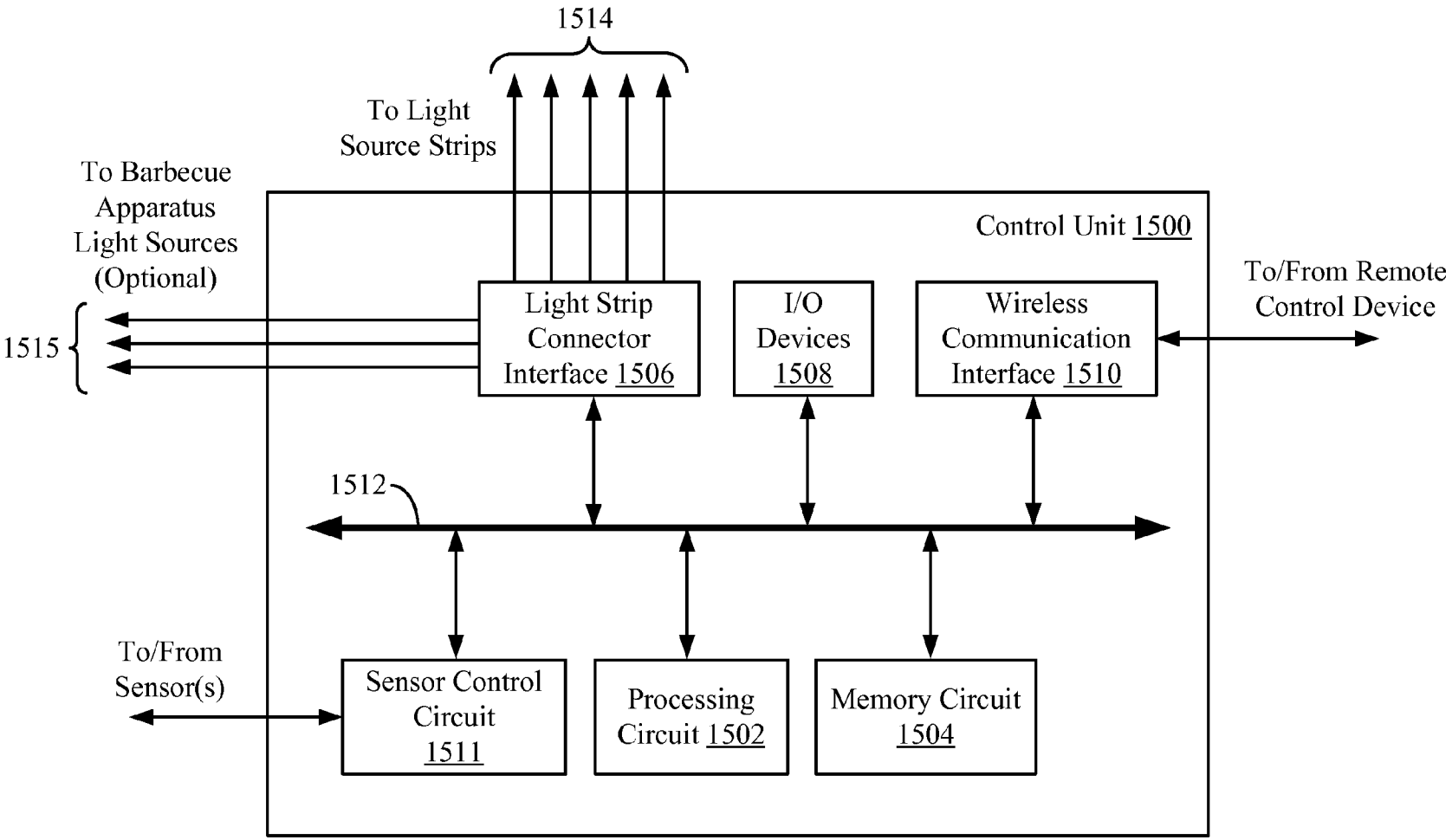
FIG. 15 illustrates a schematic block diagram of a control unit.

FIG. 15 illustrates a schematic block diagram of a control unit 1500 according to one aspect. The control unit 1500 supplies power to and communication signals to one or more illuminating panels 150, 150*a* (see FIG. 1) that are coupled to the control unit 1500. Specifically, the control unit 1500 provides power to the light source strips 710 (see FIG. 7) of the illuminating panels and also provides communication signals and commands that control the operation of the light source strips' lights 712. The control unit 1500 may include a processing circuit 1502 (processor, central processing unit (CPU), etc.), a memory circuit 1504, a light source strip connector interface 1506, input/output (I/O) devices 1508, a wireless communication interface 1510, and/or a sensor control circuit 1511. These components 1502, 1504, 1506, 1508, 1510, 1511 may be communicatively coupled to one another, for example, by a communication bus 1512.

The processing circuit 1502 may generally execute software and instructions stored in the memory circuit 1504. The processing circuit 1502 may, for example, issue commands to the light source strip connector interface 1506 to change the color, blink pattern, brightness, and/or special effects (e.g., cross fading, etc.) of the illuminating panels 150, 150*a* and also the barbecue apparatus light sources 122 (see FIG. 1) in the case where the illuminating panels 150, 150*a* are used with a barbecue apparatus 100. The memory circuit 1504 may include volatile and non-volatile memory, and may store software and instructions that are executed by the processing circuit 1502.

The light source strip connector interface 1506 may include a plurality of cables 1514 that each couple to a connector 714 of a communication and power cable 412 associated with an illuminating panel 150, 150*a*. The connector interface 1506 provides power and communication signals to the illuminating panels 150, 150*a* through its cables 1514. For example, the light source strip connector interface 1506 and its cables 1514 may control power ON/OFF to the light source strips 710 and also may change the color, blink pattern, brightness, and/or special effects (e.g., cross fading, etc.) of the illuminating panels' light source strips 710. According to example, the light source strip connector interface 1506 includes two (2), three (3), four (4), five (5), six (6) or more cables 1514 that each control a different illuminating panel 150, 150*a*.

The light source strip connector interface 1506 may also optionally include one or more cables/wires 1515 that couple to one or more barbecue apparatus light sources 122. The connector interface 1506 may provide power and communication signals to the barbecue apparatus light sources 122 through such wires/cables 1515. For example, the light source strip connector interface 1506 and its cables 1515 may control power ON/OFF to the barbecue apparatus light sources 122 and also may change the color, blink pattern, brightness, and/or special effects (e.g., cross fading, etc.) of the barbecue apparatus light sources 122. According to one aspect, the control unit 1500 may synchronize the color, blinking pattern, brightness, and/or special effects of the barbecue apparatus light sources with that of the illuminating panels' light source strips 710. In this fashion, all of the lights emanating from a barbecue apparatus (e.g., see barbecue apparatus 100 in FIG. 1) featuring the illuminating panels 150, 150*a* may be synchronized to change color, blink pattern, brightness, and/or special effects together. In other aspects, the color, brightness, blink pattern, and/or special effects of the barbecue apparatus light sources may be changed independently from the color, brightness, blink pattern, and/or special effects of the illuminating panels 150, 150*a*.

The I/O devices 1508 may include, among other things, a plurality of buttons and status indicator lights. For example, the I/O devices 1508 may include buttons that power ON/OFF and reset the control unit 1500. The I/O devices 1508 may also include status indicator lights (e.g., LEDs) that provide visual information regarding the status of the control unit 1500 including, but not limited to whether: the control unit 1500 is powered ON/OFF; the control unit 1500 is able to communicate with the illuminating panels 150, 150*a*; which of the control unit's 1500 cables 1514 are coupled to or can communicate with an illuminating panel 150, 150*a*; and the control unit 1500 is able to wireless communicate with a remote control device. According to one aspect, the I/O devices 1508 may also include speakers that play music.

The wireless communication interface 1510 allows for relatively short range communication between the control unit 1500 and a remote control device. The wireless communication interface 1510 may, for example, utilize Wi-Fi®, Zigbee®, Bluetooth®, and/or other proprietary communication protocols for its short range communications.

Referring to FIGS. 1 and 15. the sensor control circuit 1511 may be communicatively coupled to one or more sensors. In the case where the control unit 1500 is used to control illuminating panels 150, 150*a* installed on a barbecue apparatus 100, the sensor control circuit 1511 may be communicatively coupled to one or more sensors (e.g., temperature sensor 1599) located throughout the barbecue apparatus 100. For example, one or more temperature sensors (not shown) may be located in the grill 102 (e.g., underneath the hood 120, near the grilling surfaces, and/or inserted into the food/meat being grill, etc.) and are communicatively coupled to the sensor control circuit 1511. The temperature sensor(s) 1599 provide the temperature of the grilling surface, the food, and/or underneath the hood 120. As another example, referring to FIGS. 1 and 2, the illuminating panels 150, 150*a* and/or the cabinet frame 202 (or drawer frame) may include a sensor that detects whether the illuminating panels 150, 150*a* are open or closed.

The sensor control circuit 1511 receives this temperature information and processes it. For example, the sensor control circuit 1511 may compare the temperature(s) sensed with predetermined threshold temperature values that may have been set/programmed by a user. When the temperature(s) sensed by the sensors reaches the desired threshold temperature values, the sensor control circuit 1511 may instruct the processing circuit 1502 to change at least one of the color, blinking pattern, brightness, and/or special effects of the barbecue apparatus' illuminating panels 150, 150*a*. As one non-limiting, non-exclusive example, the sensor control circuit 1511 may receive a temperature value from a sensor 1599 located underneath the hood 120 that is indicative of the temperature under the hood 120. The user may have set (using software as described below) a predetermined threshold temperature value (e.g., 450 degrees Fahrenheit) at the control unit 1500 for the desired temperature under the hood 120. When the sensed temperature reaches the set threshold temperature value, the sensor control circuit 1511 may notify the processing circuit 1502, which in turn may change the color of the illuminating panels 150, 150*a* to red and may also cause the illuminating panels 150, 150*a* to flash/blink. This notifies the user that the grill 102 has reached the proper, desired temperature. In other aspects, the illuminating panels may notify the user that the meat/food has reached a critical temperature (e.g., where the sensor is inserted into the food).

According to another example, the sensor control circuit 1511 may receive data pertaining to whether the illuminating panels 150, 150*a*, which may act as doors to cabinets and front panels for drawers, are in an open or closed position. If the illuminating panel 150, 150*a* doors are in an open position the color of that one particular illuminating panel 150, 150*a* may change color and be a different color from the other doors which are in a closed position. Upon closing to open illuminating panel 150, 150*a* door, the illuminating panel 150, 150*a* may change back to its original color and match the other closed doors. In this fashion, a user may visually observe whether they have inadvertently left one of the illuminating panel 150, 150*a* doors open.

Referring to FIGS. 1, 4, and 15, in the case where the illuminating panels 150, 150*a* are utilized as doors and front panels of barbecue apparatus/island cabinets and drawers, respectively, the control unit 1500 and its cabling 1514 may be stored in a drawer or cabinet storage cavity 406 so that they are substantially out of sight.

Figure 16:
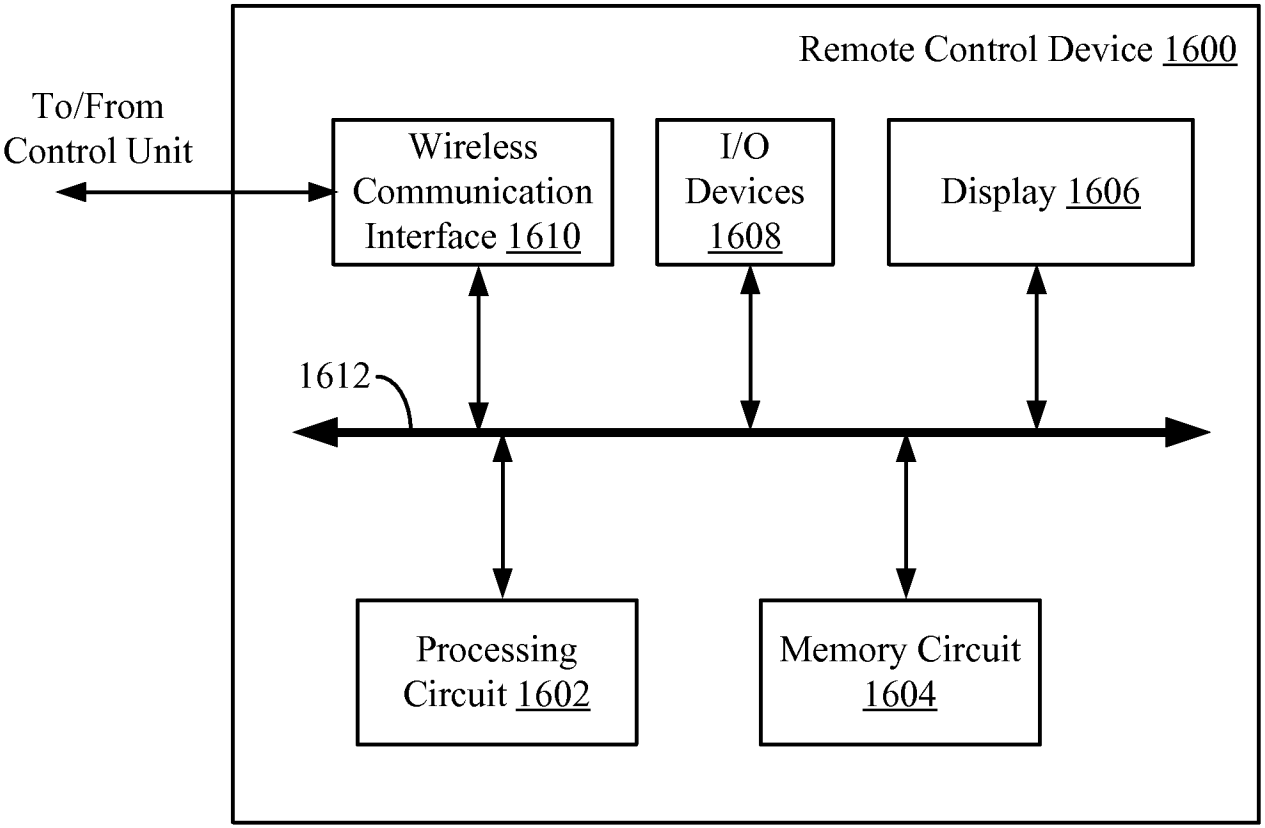
FIG. 16 illustrates a schematic block diagram of a remote control device that wirelessly communicates to a control unit.

FIG. 16 illustrates a schematic block diagram of a remote control device 1600 according to one aspect. The remote control device 1600 allows for a user to control the illuminating panels 150, 150*a* from a distance. The remote control device 1600 may be any wireless communication device including, but not limited to, a tablet, a smartphone, an infrared remote control, a laptop, a desktop computer, a smartwatch, wearable optical head-mounted displays, etc. The remote control device 1600 may include a processing circuit 1602 (processor, CPU, etc.), a memory circuit 1604, a display 1606, I/O devices 1608, and/or a wireless communication interface 1610. These components 1602, 1604, 1606, 1608, 1610 may be communicatively coupled to one another, for example, by a communication bus 1612.

The processing circuit 1602 may generally execute software and instructions stored in the memory circuit 1604. The processing circuit 1602 may, for example, transmit messages to the control unit 1500 causing the control unit 1500 to issue commands that change the color, blink pattern, brightness, and/or special effects (e.g., cross fading, etc.) of the illuminating panels 150, 150*a*. The memory circuit 1604 may include volatile and non-volatile memory, and may store software and instructions that are executed by the processing circuit 1602. For example, the memory circuit 1604 may store instructions associated with illuminating panel control software. The software allows a user to control various features of the illuminating panels 150, 150*a*.

The display 1606 may be any display device including, but not limited to, liquid crystal displays (LCD), plasma screens, flat panel monitors, and/or a touchscreen display. For example, it may be the display on a smartphone, a table, a laptop, a smartwatch, etc. The display 1606 may display a graphical user interface (GUI) associated with the illuminating panel control software described above.

The I/O devices 1608 may include, among other things, a keyboard, a mouse, a touchscreen display, status indicator lights, speakers, and/or buttons. For example, the I/O devices 1608 may include buttons, a keyboard, and/or a mouse that can be used to make selections on a GUI that control the illuminating panels 150, 150*a* (e.g., change color, brightness, blink pattern, special effects, etc.).

The wireless communication interface 1610 allows for relatively short range communication between the remote control device 1600 and the control unit 1500. Thus, the wireless communication interface 1610 transmits and receives messages to and from the control unit 1500 wirelessly. The wireless communication interface 1510 may, for example, utilize infrared (IR) signals, Wi-Fi®, Zigbee®, Bluetooth®, and/or other proprietary communication protocols for its short range communications.

The remote control device 1600 may be able to store and play music. The remote control device 1600 may also wirelessly transmit (using its communication interface 1610) music data associated with stored or streaming music to the control unit 1500.

Figure 17:
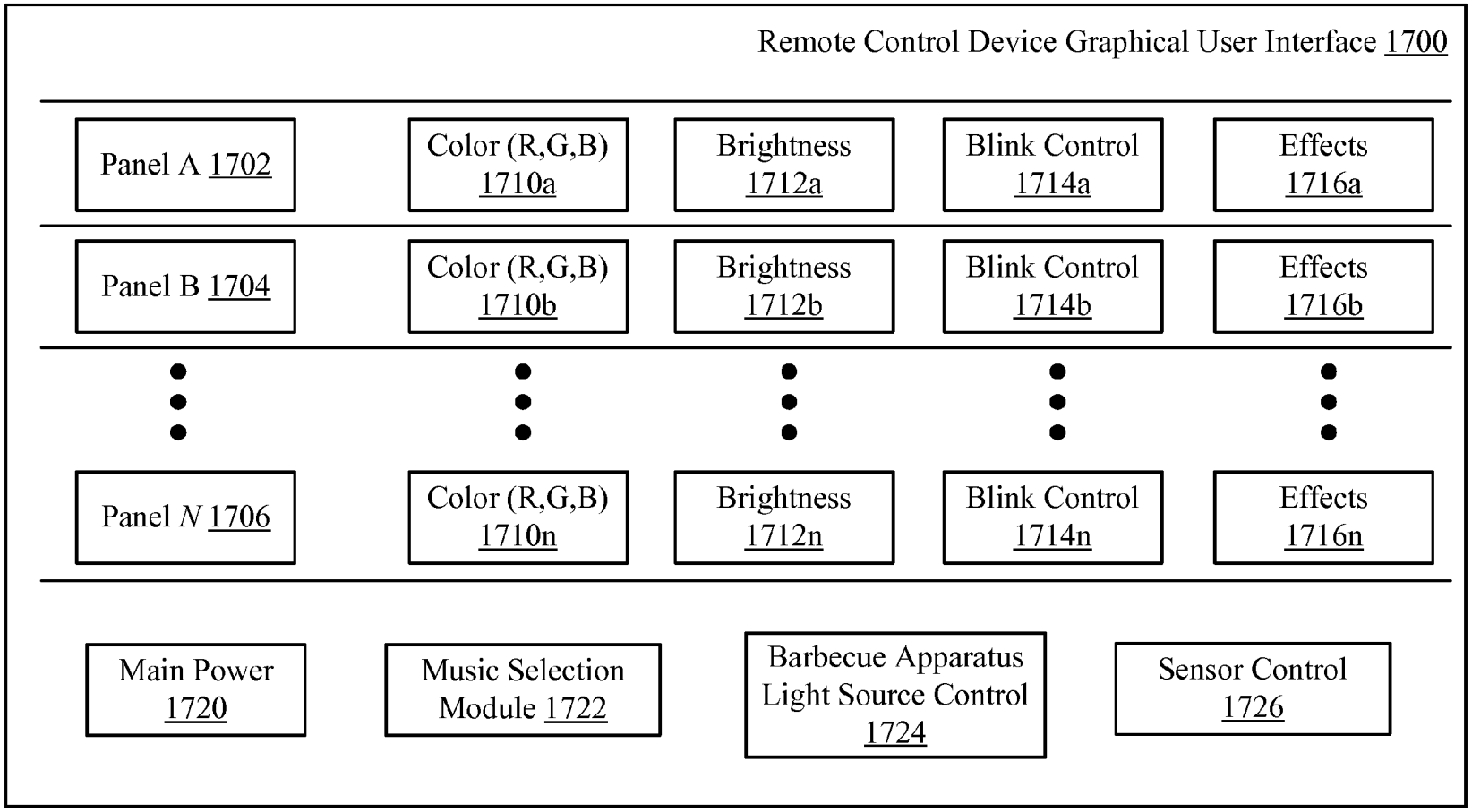
FIG. 17 illustrates a schematic diagram of a graphical user interface associated with an illuminating panel control software.

FIG. 17 illustrates a schematic diagram of a graphical user interface (GUI) 1700 associated with an illuminating panel control software according to one aspect of the disclosure. The GUI 1700 may be displayed on the remote control device 1600 (e.g., see display 1606 of FIG. 16). Referring to FIG. 17, the GUI 1700 may include a plurality of buttons 1702, 1704, 1706, 1710*a*, 1710*b* . . . 1710*n*, 1712*a*, 1712*b* . . . 1712*n*, 1714*a*, 1714*b* . . . 1714*n*, 1716*a*, 1716*b* . . . 1716*n* that control various features of the plurality of illuminating panels 150, 150*a* (e.g., N number of illuminating panels) that the control unit 1500 is coupled to.

For example, a button 1702 powers panel A ON/OFF. Other buttons 1710*a*, 1712*a*, 1714*a*, 1716*a* are associated with panel A as well. For example, a color control button 1710*a* allows the user to select the color of illuminating panel A. This may be done by allowing the user to make a selection from a list of colors (e.g., red, orange, yellow, green, blue, purple, white, etc.) or by allowing the user to control the exact red, blue, and green values (e.g., each value may range from 0 to 255). The brightness control button 1712*a* allows a user to control the brightness of illuminating panel A. The blink control button 1714*a* allows a user to control enable blinking of illuminating panel A and also the specific blinking pattern. The special effects control button 1716*a* allows a user to control specific build-in modes and special effects for illuminating panel A, such as cross-fading between colors, the rate of change between colors, etc. Similar buttons 1710*b*, 1712*b*, 1714*b*, 1716*b* control illuminating panel B. Generally each illuminating panel N coupled to the control unit 1500 (see FIG. 15) may have a plurality of such buttons 1710*n*, 1712*n*, 1714*n*, 1716*n* that control the aforementioned features of the illuminating panels.

The GUI 1700 may also include a main power button 1720 that turns OFF/ON the control unit 1500 and also a music selection module 1722 that allows a user to select music to be played from speakers at the remote control device 1600 and/or the control unit 1500. The color, brightness, blinking, and/or special effects of the individual illuminating panels may be synchronized with the music selected. For example, the illuminating panels may blink when strong bass notes are played, colors may change with different songs, etc.

The GUI 1700 may also include a barbecue apparatus light source control button 1724 and a sensor control button 1726. The barbecue apparatus light source control button 1724 may open additional menus that allow a user to change the lighting of the barbecue apparatus' other lights 122 (see barbecue apparatus 100 in FIG. 1). For example, the button 1724 may allow a "synchronized mode" where the barbecue apparatus lights sources 122 match the same color, blink pattern, brightness level, and/or special effects of the illuminating panels 150, 150*a*.

The sensor control button 1726 may allow a user to control the various sensors that the barbecue apparatus 100 may have installed. For example, the sensor control button 1726 allows a user to enter in the desired, predetermined threshold temperature value(s) described above. The button 1726 may also allow the user to control what actions the illuminating panels 150, 150*a* take to notify the user that the desired temperature(s) has been reached. For example, the button 1726 may allow the user to set what color and/or blinking pattern the illuminating panels 150, 150*a* change to when the desired temperature(s) has been reached.

One or more of the components, steps, features, and/or functions illustrated in FIGS. 1, 2, 3, 4, 5, 6, 7, 8, 9, 10, 11, 12, 13, 14, 15, 16, and/or 17 may be rearranged and/or combined into a single component, step, feature or function or embodied in several components, steps, or functions. Additional elements, components, steps, and/or functions may also be added without departing from the invention. The algorithms described herein may also be efficiently implemented in software and/or embedded in hardware.

Also, it is noted that the aspects of the present disclosure may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

Moreover, a storage medium may represent one or more devices for storing data, including read-only memory (ROM), random access memory (RAM), magnetic disk storage mediums, optical storage mediums, flash memory devices and/or other machine-readable mediums and, processor-readable mediums, and/or computer-readable mediums for storing information. The terms "machine-readable medium", "computer-readable medium", and/or "processor-readable medium" may include, but are not limited to non-transitory mediums such as portable or fixed storage devices, optical storage devices, and various other mediums capable of storing or containing instruction(s) and/or data. Thus, the various methods described herein may be fully or partially implemented by instructions and/or data that may be stored in a "machine-readable medium", "computer-readable medium", and/or "processor-readable medium" and executed by one or more processors, machines and/or devices.

Furthermore, aspects of the disclosure may be implemented by hardware, software, firmware, middleware, microcode, or any combination thereof. When implemented in software, firmware, middleware or microcode, the program code or code segments to perform the necessary tasks may be stored in a machine-readable medium such as a storage medium or other storage(s). A processor may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The various illustrative logical blocks, modules, circuits, elements, and/or components described in connection with the examples disclosed herein may be implemented or performed with a general purpose processor, a digital signal processor (DSP), an application specific integrated circuit (ASIC), a field programmable gate array (FPGA) or other programmable logic component, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing components, e.g., a combination of a DSP and a microprocessor, a number of microprocessors, one or more microprocessors in conjunction with a DSP core, or any other such configuration.

The methods or algorithms described in connection with the examples disclosed herein may be embodied directly in hardware, in a software module executable by a processor, or in a combination of both, in the form of processing unit, programming instructions, or other directions, and may be contained in a single device or distributed across multiple devices. A software module may reside in RAM memory, flash memory, ROM memory, EPROM memory, EEPROM memory, registers, hard disk, a removable disk, a CD-ROM, or any other form of storage medium known in the art. A storage medium may be coupled to the processor such that the processor can read information from, and write information to, the storage medium. In the alternative, the storage medium may be integral to the processor.

Those of skill in the art would further appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system.

The various features of the invention described herein can be implemented in different systems without departing from the invention. It should be noted that the foregoing aspects of the disclosure are merely examples and are not to be construed as limiting the invention. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

What is claimed is:

1. An illuminating panel comprising:

a pane stack including a first pane, a second pane, and a buffer layer positioned in between the first pane and the second pane, the first pane including a substantially smooth and transparent front surface and an etched and/or sandblasted back surface that diffuses light, the second pane including a front surface and a back surface, at least one of the second pane's front surface and/or the second pane's back surface being reflective, and wherein the buffer layer is a laminate that adheres to the first pane's back surface and the second pane's front surface to secure the first pane and the second pane together and resist moisture from penetrating between the first pane and the second pane;

a perimeter light source having a plurality of light sources positioned outside of the pane stack that substantially surrounds a perimeter of the pane stack, the perimeter light source adapted to provide light to the pane stack through side surfaces of the pane stack; and a housing that houses the pane stack and the perimeter light source.

2. The illuminating panel of claim 1, further comprising:

a control unit communicatively coupled to the perimeter light source and adapted to provide power and communication signals to the perimeter light source.

3. The illuminating panel of claim 2, wherein the communication signals provided by the control unit control at least one of a color, a brightness, and/or a blinking pattern of the plurality of light sources of the perimeter light source.

4. The illuminating panel of claim 3, wherein the control unit includes a wireless communication interface adapted to communicate with a remote control device, the remote control device having a graphical user interface (GUI) allowing a user to make selections that wirelessly control at least one or a color, brightness, blinking pattern, and/or special effects of the plurality of light sources.

5. The illuminating panel of claim 1, further comprising:

one or more hinges coupling the illuminating panel to a cabinet frame or a drawer frame including a cavity, the hinges adapted to swing the illuminating panel between a closed position and an open position, the illuminating panel sealing the cavity in the closed position and exposing the cavity in the open position.

6. The illuminating panel of claim 5, wherein the cabinet frame or door frame is part of a barbecue apparatus that includes a heating source.

7. The illuminating panel of claim 1, wherein the housing includes an outer frame and a rear cover plate, the rear cover plate securing to a back side of the outer frame to enclose the pane stack and the perimeter light source within the housing.

8. The illuminating panel of claim 7, wherein the outer frame includes a front surface having an open center portion that exposes a front surface of the pane stack.

9. The illuminating panel of claim 1, further comprising:

a pane stack brace that secures the pane stack to the housing.

10. The illuminating panel of claim 9, wherein the pane stack brace includes a first member having a first surface and a second member having a second surface, the first and second surfaces being substantially orthogonal to each other, the first surface facing the side surfaces of the pane stack and securing the perimeter light source, and the second surface coupling to a back side perimeter of the pane stack.

11. The illuminating panel of claim 1, wherein the laminate is at least one of polyvinyl butyral or ethylene-vinyl acetate.

12. An apparatus comprising:

a frame;

a barbecue grill positioned on the frame;

a heating source coupled to the barbecue grill and adapted to heat the barbecue grill; and at least one of a drawer and/or a cabinet coupled to the frame, the at least one drawer and/or cabinet including an illuminating panel, the illuminating panel including:

a pane stack having a perimeter;

a perimeter light source having a plurality of light sources that extend and substantially surround the perimeter of the pane stack, the perimeter light source adapted to provide light to the pane stack through side surfaces of the pane stack;

a pane stack brace that couples to and supports the pane stack, the pane stack brace including a first member having a first surface and a second member having a second surface, the first and second surfaces being substantially orthogonal to each other and extending substantially around an entire perimeter of the pane stack, the first surface facing the side surfaces of the pane stack and securing the perimeter light source to extend and substantially surround the perimeter of the pane stack, and the second surface supporting a back side perimeter of the pane stack;

a housing that houses the pane stack, the pane stack brace, and the perimeter light source, the housing including an outer frame having an open center portion that exposes a front surface of the pane stack, the open center portion defined by an inner perimeter of a back side surface of the outer frame;

a padding layer that resides on and substantially surrounds the inner perimeter of the back side surface of the outer frame; and means for securing the pane stack brace to the housing and presses the pane stack against the padding layer to create a water resistant seal between the outer frame and the pane stack.

13. The apparatus of claim 12, wherein the housing includes rear cover plate securing to a back side of the outer frame to enclose the pane stack and the perimeter light source within the housing.

14. The apparatus of claim 12, wherein the pane stack includes a first pane, a second pane, and a buffer layer positioned in between the first pane and the second pane, the first pane and the second pane each having transparent or translucent side surfaces that allow light generated at the perimeter light source to pass through.

15. The apparatus of claim 12, further comprising:

a control unit communicatively coupled to the perimeter light source and adapted to provide power and communication signals to the perimeter light source, the communication signals provided by the control unit control at least one of a color, a brightness, and/or a blinking pattern of the plurality of light sources of the perimeter light source; and a remote control device adapted to wirelessly communicate with the control unit, the remote control device having a display that shows a graphical user interface (GUI) allowing a user to make selections that wirelessly control at least one or a color, brightness, blinking pattern, and/or special effects of the plurality of light sources.

16. The apparatus of claim 15, further comprising:

a temperature sensor adapted to determine a temperature of the barbecue grill, the temperature sensor communicatively coupled to the control unit;

wherein the control unit receives the temperature of the barbecue grill from the temperature sensor and compares it to a predetermined threshold temperature value, and if the temperature of barbecue grill received equals or exceeds the predetermined threshold temperature value the control unit changes at least one of the color, the brightness, the blinking pattern, and/or the special effects of the plurality of light sources.

17. An apparatus comprising:

a frame;

a barbecue grill positioned on the frame;

a heating source coupled to the barbecue grill and adapted to heat the barbecue grill; and at least one of a drawer and/or a cabinet coupled to the frame, the at least one drawer and/or cabinet including an illuminating panel that is adapted to illuminate and be adjustable in at least one of color, blinking pattern, brightness, and/or change special effect, the illuminating panel including a pane stack that includes a first pane, a second pane, and a buffer layer positioned in between the first pane and the second pane, the first pane including a substantially smooth and transparent front surface and an etched and/or sandblasted back surface that diffuses light, the second pane including a front surface and a back surface, at least one of the second pane's front surface and/or the second pane's back surface being reflective, and wherein the buffer layer is a laminate that adheres to the first pane's back surface and the second pane's front surface to secure the first pane and the second pane together and resist moisture from penetrating between the first pane and the second pane.

18. The apparatus of claim 17, wherein the laminate is at least one of polyvinyl butyral or ethylene-vinyl acetate.

* * * * *